US008947318B2

(12) United States Patent
Bungo

(10) Patent No.: US 8,947,318 B2
(45) Date of Patent: Feb. 3, 2015

(54) ANTENNA APPARATUS

(75) Inventor: Akihiro Bungo, Tokyo (JP)

(73) Assignee: Sony Mobile Communications Inc., Tokyo (JP)

( * ) Notice: Subject to any disclaimer, the term of this patent is extended or adjusted under 35 U.S.C. 154(b) by 273 days.

(21) Appl. No.: 13/358,059

(22) Filed: Jan. 25, 2012

(65) Prior Publication Data

US 2012/0268345 A1 Oct. 25, 2012

Related U.S. Application Data

(60) Provisional application No. 61/478,288, filed on Apr. 22, 2011.

(51) Int. Cl.

| | |
|---|---|
| ***H01Q 21/00*** | (2006.01) |
| ***H01Q 1/52*** | (2006.01) |
| ***H01Q 1/24*** | (2006.01) |
| ***H01Q 21/28*** | (2006.01) |
| *H01Q 9/42* | (2006.01) |

(52) U.S. Cl.

CPC ..... *H01Q 1/521* (2013.01); *H01Q 1/243* (2013.01); *H01Q 21/28* (2013.01); *H01Q 9/42* (2013.01)

USPC ..... 343/893; 343/853; 343/810; 343/834

(58) Field of Classification Search

CPC ..... H01Q 1/38; H01Q 21/08; H01Q 21/24; H01Q 1/243; H01Q 21/28; H01Q 1/521; H01Q 9/42

See application file for complete search history.

(56) References Cited

U.S. PATENT DOCUMENTS

| | | | | |
|---|---|---|---|---|
| 6,940,458 | B2 * | 9/2005 | Mukai et al. | 343/700 MS |
| 8,179,324 | B2 * | 5/2012 | Rao et al. | 343/700 MS |
| 2004/0227669 | A1 * | 11/2004 | Okado | 343/700 MS |
| 2007/0069960 | A1 | 3/2007 | Moon et al. | |
| 2008/0309631 | A1 | 12/2008 | Westerman et al. | |
| 2008/0316098 | A1 | 12/2008 | Mitsui | |
| 2009/0102742 | A1 * | 4/2009 | Park et al. | 343/876 |
| 2009/0309851 | A1 | 12/2009 | Bernstein | |
| 2010/0053022 | A1 | 3/2010 | Mak et al. | |
| 2010/0220016 | A1 * | 9/2010 | Nissinen et al. | 343/702 |
| 2011/0248895 | A1 | 10/2011 | Bungo et al. | |
| 2012/0050333 | A1 | 3/2012 | Bernstein | |
| 2013/0069836 | A1 * | 3/2013 | Bungo | 343/724 |

FOREIGN PATENT DOCUMENTS

| | | | |
|---|---|---|---|
| CN | 1588694 | A | 3/2005 |
| CN | 201117823 | Y | 9/2008 |

(Continued)

OTHER PUBLICATIONS

Extended European Search Report issued Aug. 30, 2012, in Patent Application No. 12159726.4.

(Continued)

*Primary Examiner* — Trinh Dinh

(74) *Attorney, Agent, or Firm* — Oblon, Spivak, McClelland, Maier & Neustadt, L.L.P.

(57) ABSTRACT

An antenna apparatus that includes a first antenna having a first feed point, a second antenna having a second feed point, and a first non-feed element grounded at a first ground point disposed at a first predetermined distance from the first feed point and the second feed point.

16 Claims, 29 Drawing Sheets

(56) References Cited

FOREIGN PATENT DOCUMENTS

| | | | |
|---|---|---|---|
| CN | 201345425 | Y | 11/2009 |
| CN | 101821902 | A | 9/2010 |
| EP | 1 768 211 | A1 | 3/2007 |
| EP | 2 006 953 | A1 | 12/2008 |
| JP | 2006-042111 | A | 2/2006 |
| JP | 2008-017047 | | 1/2008 |
| JP | 2009-246560 | A | 10/2009 |
| JP | 4667310 | B2 | 4/2011 |

OTHER PUBLICATIONS

Combined Office Action and Search Report issued Dec. 24, 2013 in Chinese Patent Application No. 201210079189.9 with English language translation.

Extended European Search Report issued Jun. 27, 2014 in Patent Application No. 12159526.8.

Dongho Kim, et al., "Design of a dual-band mimo antenna for mobile WiMax application", Microwave and Optical Technology Letters, vol. 53, No. 2, XP055028060, Feb. 1, 2011, pp. 410-414.

* cited by examiner 100
20
21
41
40
11
10

Y
X
33

100
20
21
41
40
11
10

Y
X
34

ANTENNA APPARATUS

CROSS REFERENCE TO RELATED APPLICATION

The present application claims the benefit of the earlier filing date of U.S. Provisional Patent Application Ser. No. 61/478,288 filed on Apr. 22, 2011, the entire contents of which is incorporated herein by reference.

BACKGROUND

1. Field of the Disclosure

The present disclosure relates to an antenna apparatus, and more particularly relates to (but not in the sense of being limited to) a MIMO antenna apparatus and a wireless communication apparatus implementing such.

2. Description of Related Art

Services called LTE (Long Term Evolution) are being initiated by some communication business operators (operators) as a high-speed data communication specification for mobile phones. When seen from a technical perspective in terms of antennas, LTE has characteristics like the following.

Namely, LTE is a communication system called MIMO (Multi Input Multi Output), which realizes high-speed data communication by using a plurality of antennas to send and receive signals. In portable terminals implementing MIMO, ordinarily two antennas are used. It is sought that the two antenna characteristics ideally be equal.

With regard to antenna characteristics, an indicator called the antenna correlation becomes a key point. Communication speed lowers if the numerical values (coefficients) of antenna correlation are high (in other words, the degree of correlation is high).

Currently, it is desired that the frequency band used by LTE services scheduled in respective countries be extended over a wide range, and that the low bands and high bands of current cellular systems be widened.

For example, in the United States services in the 700 MHz band are scheduled to be initiated, but lowering correlation in the 700 MHz band becomes a significant difficulty. The reason for this is because high-frequency current flows throughout the mobile terminal board as the frequency lowers, becoming an operational mode similar to a dipole, and antenna directionality stops being very dependent on the antenna design. Thus, even if it is attempted to improve correlation by modifying the design of one of the antennas to change the directionality, obtaining desired results is very difficult.

In Japanese Unexamined Patent Application Publication No. 2008-17047, a multi-antenna applicable to a mobile communication system with low mutual coupling effects is proposed. This multi-antenna is provided with plural feed elements respectively coupled to plural feed points on a circuit board, as well as a single or plural non-feed elements coupled to the circuit board in the vicinity of an arbitrary feed point.

SUMMARY

As discussed above, in a mobile terminal or other wireless communication apparatus implementing MIMO, ordinarily it is sought that the antenna characteristics of the two antennas ideally be equal. However, if a non-feed element is coupled in the vicinity of a feed element as in the above related art, there is a possibility that a differential in antenna efficiency will develop. Consequently, the above related art is not suited toward MIMO, wherein antennas of ideally the same antenna efficiency are preferable.

Given such background, the Inventor has recognized the desirability of an antenna apparatus having a low degree of correlation and balanced antenna efficiency for a plurality of antennas.

According to an exemplary embodiment, the present disclosure is directed to an antenna apparatus that includes a first antenna having a first feed point, a second antenna having a second feed point, and a first non-feed element grounded at a first ground point disposed at a first predetermined distance from the first feed point and the second feed point.

According to an embodiment of the present disclosure, an antenna apparatus suited towards an MIMO system and having a low degree of correlation and balanced antenna efficiency for a plurality of antennas is obtained, and thus a wireless communication apparatus using such is obtained.

DETAILED DESCRIPTION

First, before explaining an embodiment of the present disclosure, an exemplary configuration and problems of an antenna apparatus in a wireless communication apparatus to which the present disclosure is applied will be explained.

Figure 1:
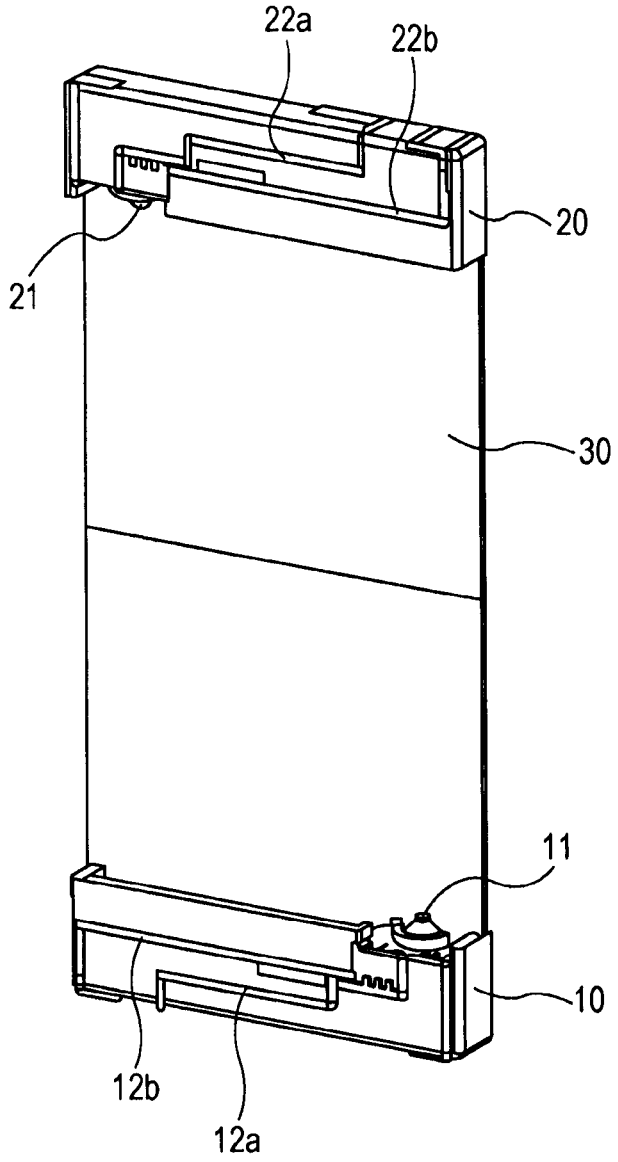
FIG. 1 is a diagram illustrating the principal configuration of an antenna apparatus to which an embodiment of the present disclosure is applied.

FIG. 1 illustrates the principal configuration of an antenna apparatus to which the present embodiment is applied.

An antenna apparatus has, as a plurality of antennas for conducting MIMO transmission, a first antenna unit 10 (main antenna) having a first feed point 11 and a second antenna unit 20 (sub antenna) having a second feed point 21. The antenna units 10 and 20 are respectively disposed at one end and the other end of an approximately rectangular board 30 in direction thereof (in this case, the lengthwise direction). The feed points 11 and 21 are positioned at mutually opposite sides of the board. The antenna unit 10 is multi-band compatible having a plurality of antenna elements 12*a*, 12*b*, etc. The antenna unit 20 is similarly multi-band compatible having a plurality of antenna elements 22*a*, 22*b*, etc. However, an antenna unit to which the present disclosure is applied is not necessarily multi-band compatible, and may also be single-band compatible. Various components are mounted on the board 30, and the board 30 additionally includes a ground plane.

Figure 2A:
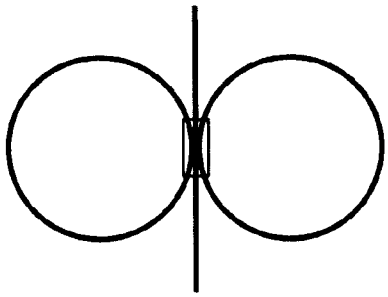
FIGS. 2(*a*), 2(*b*) and 2(*c*) are diagrams explaining the antenna apparatus in FIG. 1.
Figure 2B:
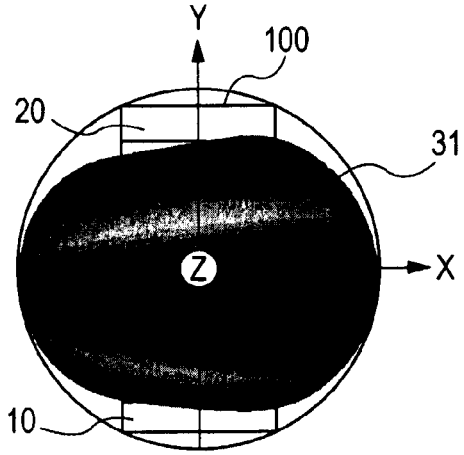
Figure 2C:
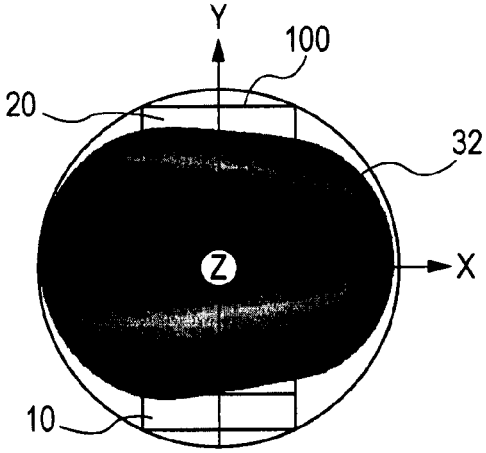

In a configuration like that illustrated in FIG. 1, the respective antenna units work in conjunction with the ground plane to have a radiation pattern resembling a dipole antenna like that illustrated in FIG. 2(*a*). In FIG. 2(*b*), a three-dimensional radiation pattern of the second antenna unit 20 is represented by shading. The vertical axis direction of the drawing follows the lengthwise direction of the wireless communication apparatus. Similarly, in FIG. 2(*c*), a three-dimensional radiation pattern of the first antenna unit 10 is represented by shading.

The radiation patterns in FIGS. 2(*b*) and 2(*c*) both have doughnut shapes taking the lengthwise axis of the wireless communication apparatus as their central axis. As a result, the correlation between the two antennas is high, and they are unsuited as MIMO antennas.

Figure 3:
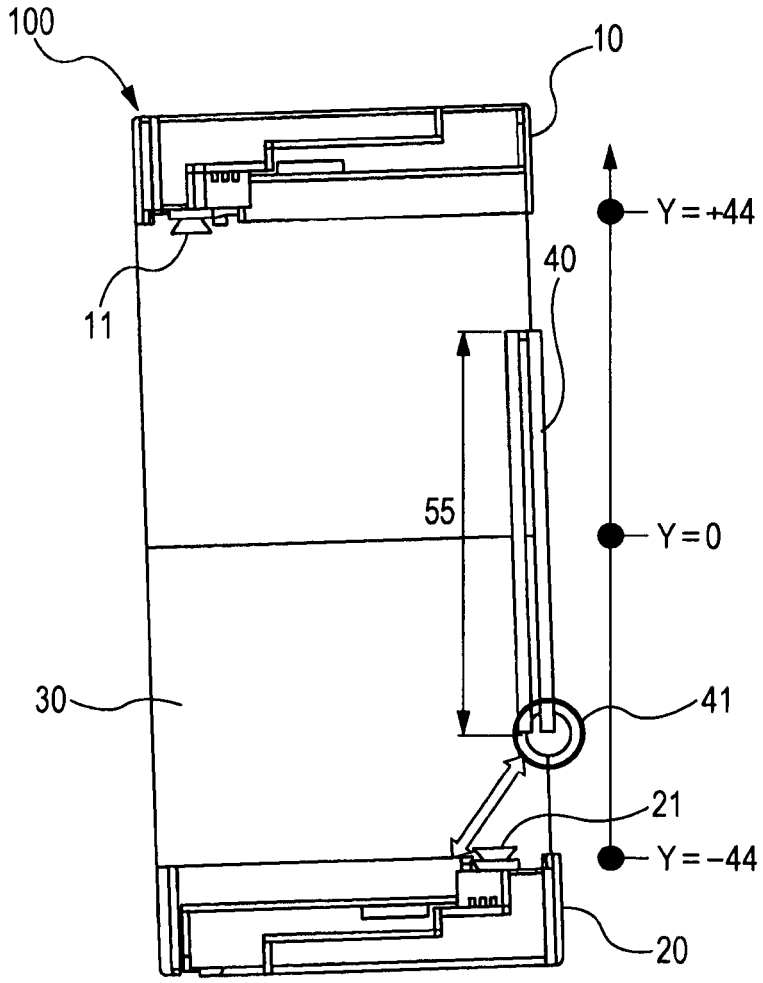
FIG. 3 is a diagram illustrating the principal configuration of an antenna apparatus in accordance with a first embodiment of the present disclosure.

FIG. 3 illustrates the principal configuration of an antenna apparatus 100 in accordance with a first embodiment of the present disclosure. This configuration is based on the configuration illustrated in FIG. 1, and like reference numerals are given to similar components.

The antenna apparatus 100 is provided with, as a plurality of MIMO antennas, a first antenna unit 10 having a first feed point 11, a second antenna unit 20 having a second feed point 21, and in addition, a non-feed element 40. The first feed point 11 is positioned near one of the long edges of the board 30, and the second feed point 21 is positioned near the other long edge of the board 30. Herein, "near a long edge" means a position between the midpoint of the short edge direction and one of the short edges, typically in the vicinity of a long edge. The non-feed element 40 is grounded to a ground point 41 distanced from both the respective feed points 11 and 21 of the first and second antenna units 10 and 20. This antenna apparatus 100 positions the element of the non-feed element 40 along a long edge of the board 30, with the interval between the antenna unit 10 and the antenna unit 20 being 88 cm. The element of the non-feed element 40 is configured to be grounded at one end thereof, extending along a long edge of the board 30 from this ground point, and then folding back in parallel. The element of this non-feed element 40 is also configured such that, after folding back in parallel, its other end is positioned near the ground point 41. Furthermore, this ground point 41 is disposed at a position comparatively near the second feed point 21 in the vicinity of the other long edge of the board 30. The folded length of the element is taken to be 55 mm. Later-described properties of the ground point 41 where confirmed at two different positions (herein, the positions at −27 mm and −37 mm) from the midpoint position in the lengthwise direction (Y=0).

Figure 4A:
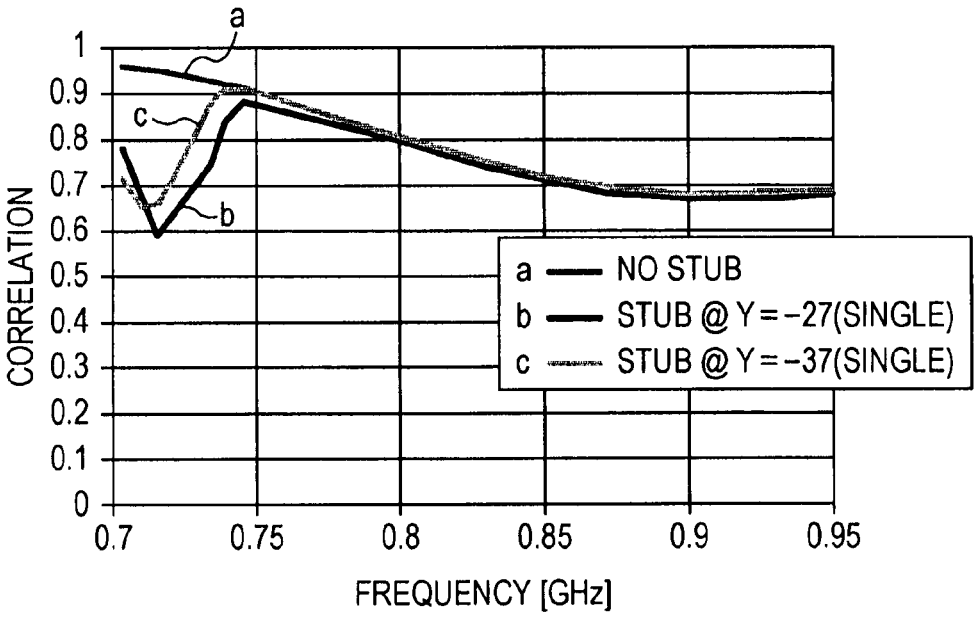
FIGS. 4(*a*) and 4(*b*) are graphs representing the frequency characteristics of the correlation and the frequency characteristics of the antenna efficiency for both antennas in the antenna apparatus configuration illustrated in FIG. 3.
Figure 4B:
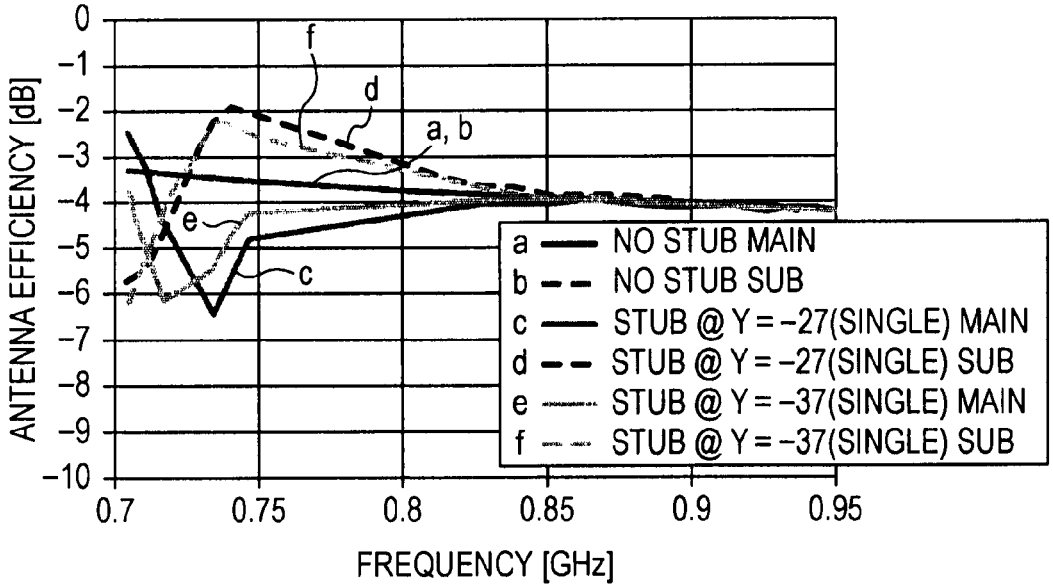

FIGS. 4(*a*) and 4(*b*) are graphs representing the frequency characteristics of the correlation and the frequency characteristics of the antenna efficiency for both antennas in the antenna apparatus configuration illustrated in FIG. 3.

In FIG. 4(*a*), the horizontal axis represents the frequency [GHz] and the vertical axis represents the correlation coefficient (from 0 to 1). The waveform a represents the case of no non-feed element (stub). The waveforms b and c respectively represent cases where the ground point of the non-feed element is taken to be at two different points (herein, −27 mm and −37 mm from the midpoint). As the drawing demonstrates, for the cases of using a non-feed element, the correlation drops (i.e., improves) in the 700 MHz band at both ground points compared to the case without a non-feed element.

In FIG. 4(*b*), the horizontal axis represents the frequency [GHz] and the vertical axis represents the antenna efficiency [dB]. The waveform a represents the antenna efficiency of the main antenna (the antenna unit 10) in the case of no non-feed element (stub). The waveform b represents the antenna efficiency of the sub antenna (the antenna unit 20) in the case of no non-feed element (stub). The waveform c represents the antenna efficiency of the main antenna with the ground point of the non-feed element taken to be at the −27 mm position. The waveform d represents the antenna efficiency of the sub antenna with the ground point of the non-feed element taken to be at the −27 mm position. The waveform e represents the antenna efficiency of the main antenna with the ground point of the non-feed element taken to be at the −37 mm position. The waveform f represents the antenna efficiency of the sub antenna with the ground point of the non-feed element taken to be at the −37 mm position. These graphs demonstrate that, even in cases of using a non-feed element with respect to antenna efficiency, cases where the antenna efficiency is good and cases where it is bad are possible depending on the position of the ground point.

Figure 5A:
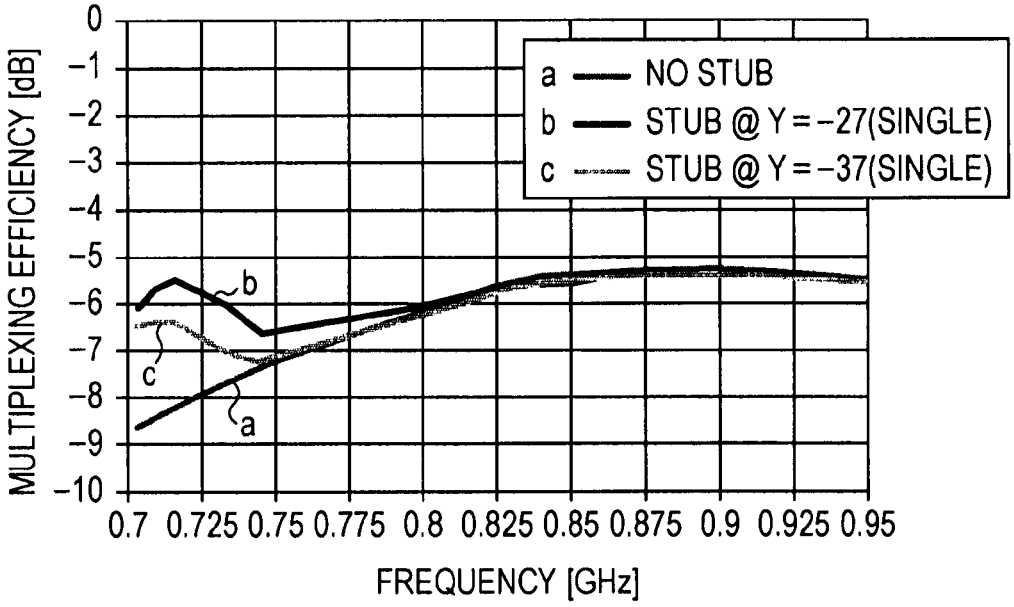
FIGS. 5(*a*) and 5(*b*) are diagrams respectively representing the frequency characteristics of the multiplexing efficiency [dB] and the gain imbalance [dB] of the antenna apparatus illustrated in FIG. 3.
Figure 5B:
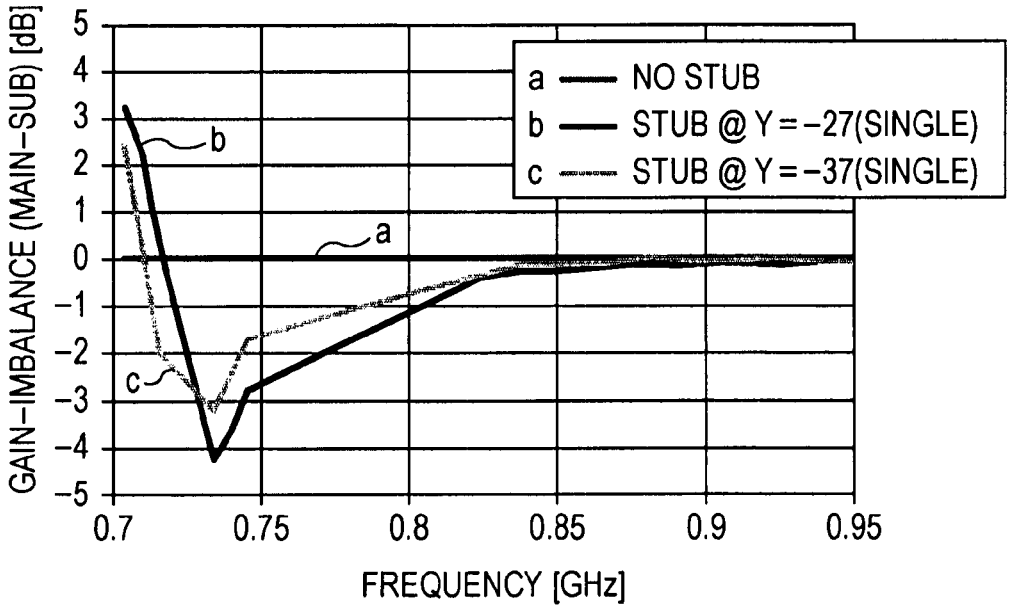

FIGS. 5(*a*) and 5(*b*) respectively represent the frequency characteristics of the multiplexing efficiency [dB] and the gain imbalance [dB] of the antenna apparatus illustrated in FIG. 3. Multiplexing efficiency is an indicator for conducting an overall evaluation of antenna properties for sending/receiving signals and antenna correlation properties, and is expressed in the following formula.

$$\eta mux=\sqrt{\{\eta 1\cdot\eta 2(1-|\gamma|\cdot|\gamma|)\}}$$

Herein, ηmux represents the multiplexing efficiency, while η1 and η2 represent the antenna efficiencies of the first and second antennas, and γ represents the correlation, or in other words, the pattern complex correlation.

The physical meaning of the multiplexing efficiency expresses the relative amount of decay from the antenna gain when received at a main antenna and sub antenna with a correlation of 0 and an antenna efficiency of 100%. The multiplexing efficiency is preferably high (close to 0). In FIG. 5(*a*), the waveform a represents the case without a non-feed element. The waveforms b and c respectively represent cases where the ground point of the non-feed element 40 is taken to be at the −27 mm and the −37 mm positions. This graph demonstrates that multiplexing efficiency is improved in the 700 MHz band by approximately 2 dB in the case of using a non-feed element.

However, as FIG. 5(*b*) demonstrates, a slight imbalance is seen between the gains of the main antenna and the sub antenna in the case of using a non-feed element.

Figure 6:
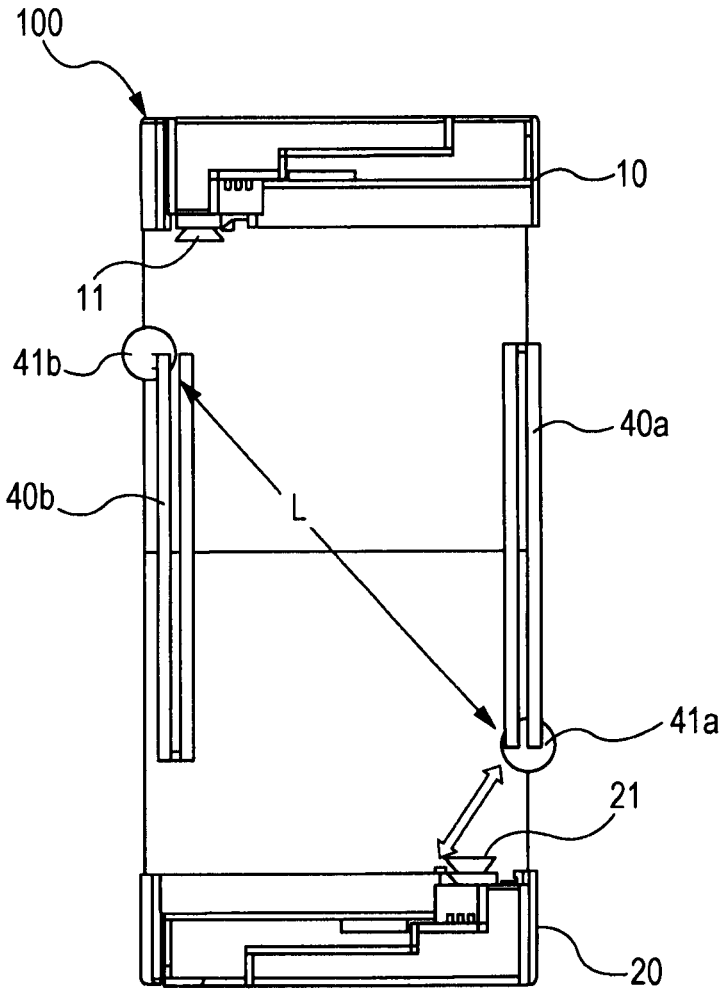
FIG. 6 is a diagram illustrating a modification of the antenna apparatus illustrated in FIG. 3.

FIG. 6 illustrates a modification of the antenna apparatus illustrated in FIG. 3. In this configuration, in addition to a first non-feed element 40*a* equivalent to the non-feed element 40 in FIG. 3, a second non-feed element 40*b* is provided along the opposite edge of the board 30. The non-feed element 40*b* is grounded at a ground point 41*b* that is the reverse of (rotationally symmetric to) the ground point 41*a* of the non-feed element 40*a*. Similarly to the non-feed element 40 in FIG. 3, the respective elements of the non-feed elements 40*a* and 40*b* are each grounded at one end thereof, extending along a long edge of the board 30 from the ground point, then folding back in parallel, with the other end positioned near the ground point 41. Also, the ground point 41*a* is positioned at a position closer to the second feed point 21 in the vicinity of the other long edge of the board 30, while the ground point 42*a* is positioned at a position comparatively near the first feed point 11 in the vicinity of the long edge of the board 30.

Figure 7A:
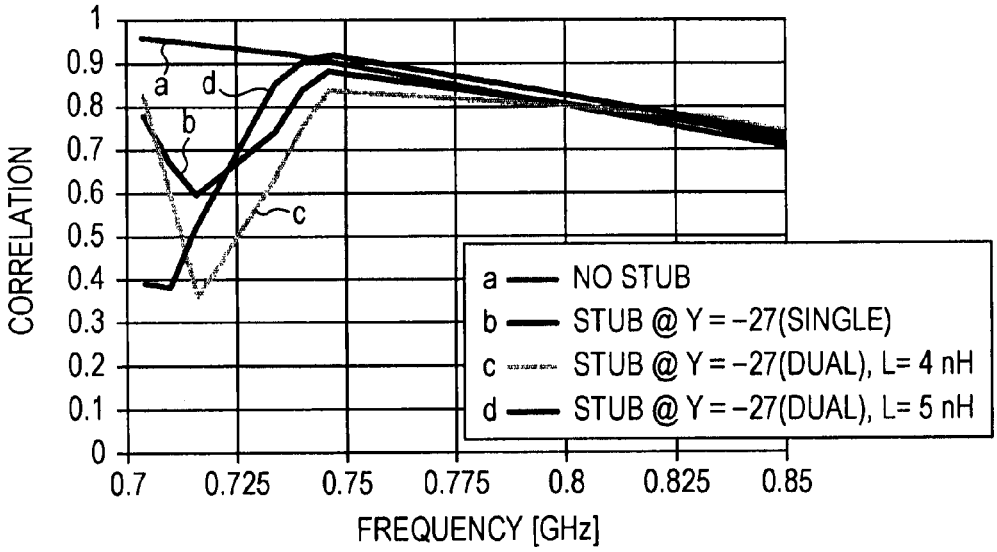
FIGS. 7(*a*) and 7(*b*) are graphs representing the frequency characteristics of the correlation and the frequency characteristics of the antenna efficiency for both antennas in the antenna apparatus configuration illustrated in FIG. 6.
Figure 7B:
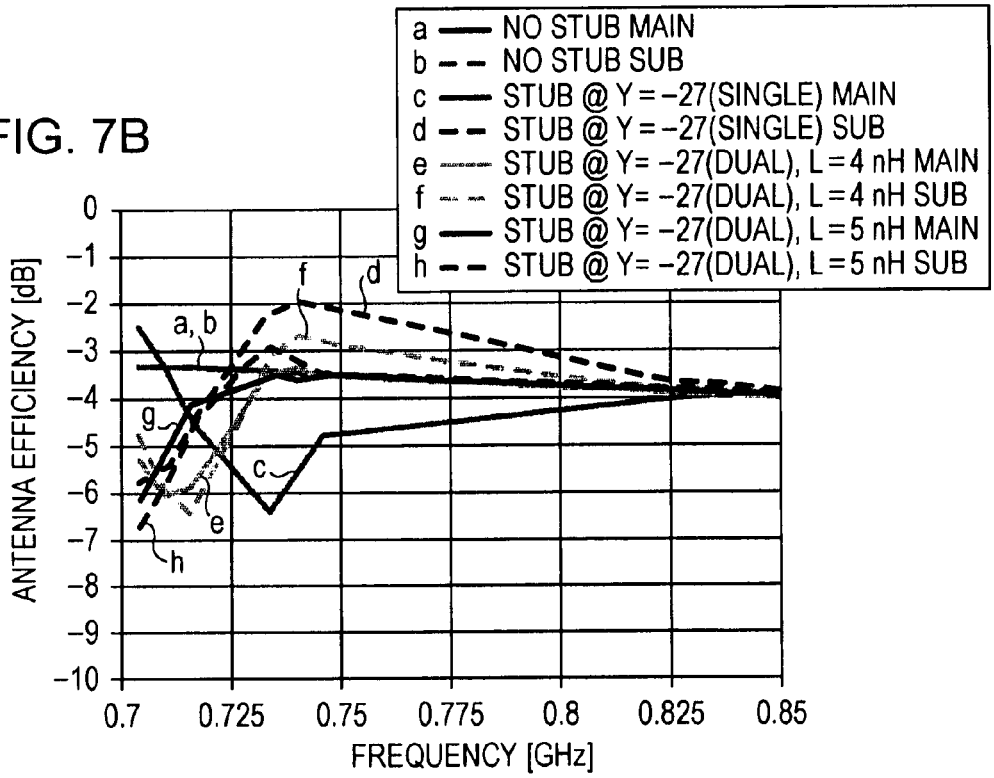

FIGS. 7(*a*) and 7(*b*) are graphs representing the frequency characteristics of the correlation and the frequency characteristics of the antenna efficiency for both antennas in the antenna apparatus configuration illustrated in FIG. 6.

In FIG. 7(*a*), the horizontal axis represents the frequency [GHz] and the vertical axis represents the correlation coefficient (from 0 to 1). The waveform a represents the case of no non-feed element. The waveform b represents the case of using a single non-feed element with a ground point at −27 mm. The waveforms c and d represent cases of using two non-feed elements with ground points at −27 mm. The difference between the waveforms c and d is that grounding of the non-feed elements was conducted via different lumped circuit elements (in this example, 4 nH and 5 nH inductors). The resonant frequency of the non-feed elements can be adjusted according to their electrical length. In contrast, according to a configuration that grounds non-feed elements via circuit elements such as lumped elements, the resonant frequency of the non-feed elements can also be adjusted by modifying the lumped elements. The details of a configuration using such circuit elements will be discussed later.

As the drawing demonstrates, for the case of using a non-feed element, the correlation drops (i.e., improves) in the 700 MHz band for all waveforms b to d compared to the case without a non-feed element.

In FIG. 7(*b*), the horizontal axis represents the frequency [GHz] and the vertical axis represents the antenna efficiency [dB]. The waveform a represents the antenna efficiency of the main antenna in the case of no non-feed element. The waveform b represents antenna efficiency of the sub antenna in the case of no non-feed element. The waveform c represents the antenna efficiency of the main antenna in the case of using a single non-feed element with a ground point at the −27 mm position. The waveform d represents the antenna efficiency of the sub antenna in the case of grounding a single non-feed element via a 4 nH inductor with the ground point at the −27 mm position. The waveform e represents the antenna efficiency of the main antenna in the case of grounding two non-feed elements via 4 nH inductors with ground points at the −27 mm position. The waveform f represents the antenna efficiency of the sub antenna in the case of grounding two non-feed elements via 4 nH inductors with ground points at the −27 mm position. The waveform g represents the antenna efficiency of the main antenna in the case of grounding two non-feed elements via 5 nH inductors with ground points at the −27 mm position. The waveform h represents the antenna efficiency of the sub antenna in the case of grounding two non-feed elements via 5 nH inductors with ground points at the −27 mm position.

These graphs demonstrate that, even in cases of using a non-feed element with respect to antenna efficiency, cases where the antenna efficiency is good and cases where it is bad are possible depending on the number of non-feed elements and the interposing inductance value. Thus, the frequency range in which to lower the correlation can be controlled by selecting the number of non-feed elements and inductance values.

Figure 8:
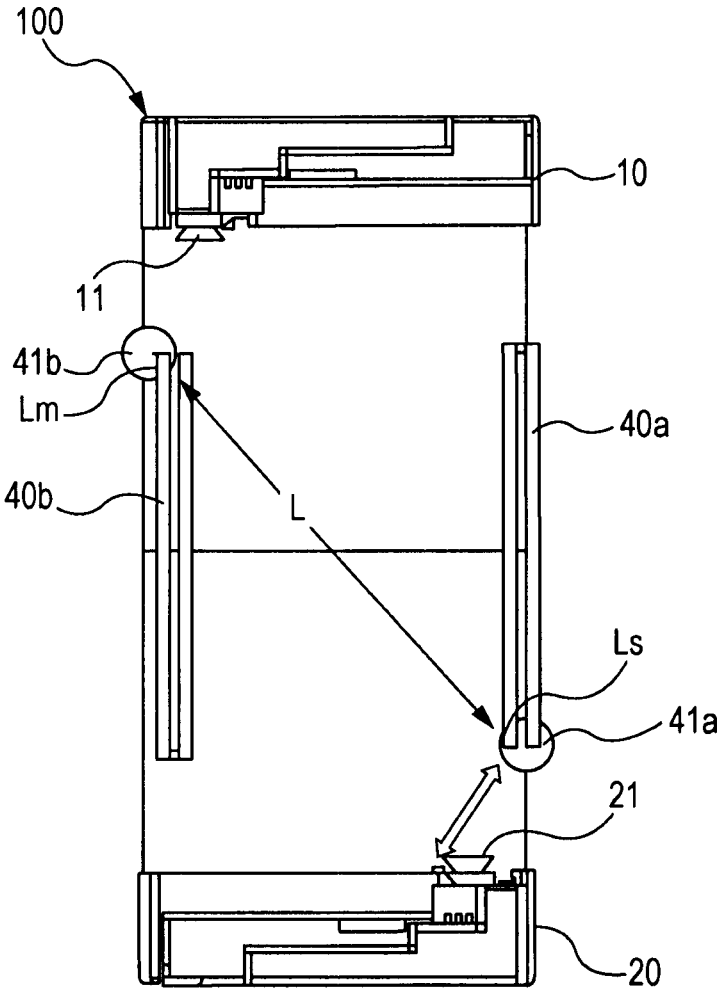
FIG. 8 is a diagram illustrating an antenna apparatus wherein the inductors respectively interposed at the first and second ground points in the antenna apparatus illustrated in FIG. 6 have been made to differ.

In FIG. 8, the inductors respectively interposed at the ground points 41*a* and 41*b* in the antenna apparatus configuration illustrated in FIG. 6 have been made to differ with different inductance values Lm and Ls. The rest of the configuration is the same as FIG. 6.

Figure 9A:
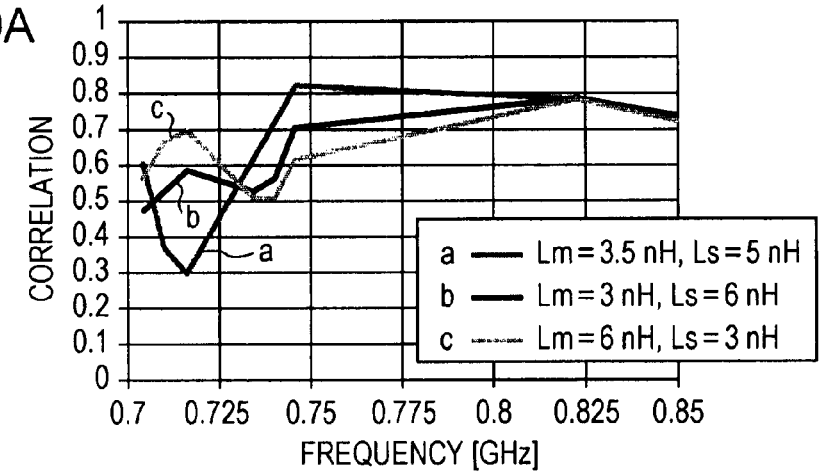
FIGS. 9(*a*), 9(*b*), and 9(*c*) are graphs respectively representing the frequency characteristics of the correlation, antenna efficiency, and multiplexing efficiency of the configuration in FIG. 8.
Figure 9B:
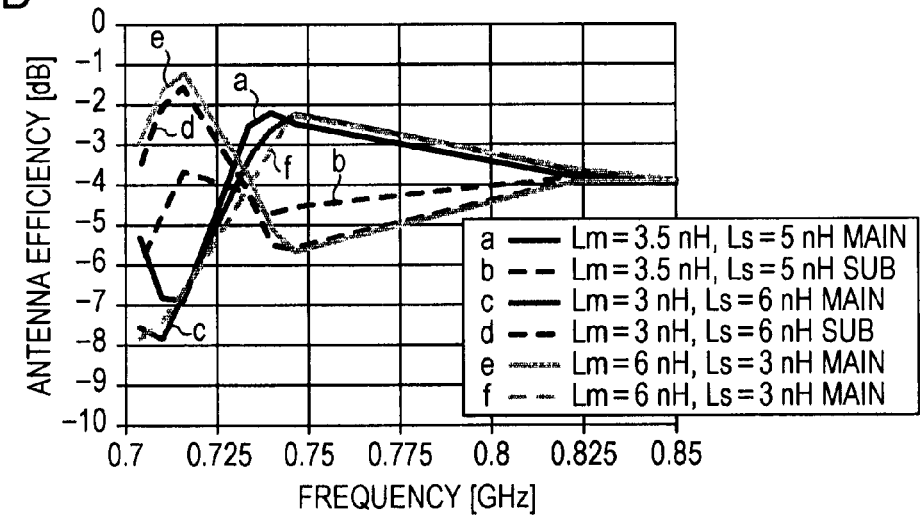
Figure 9C:
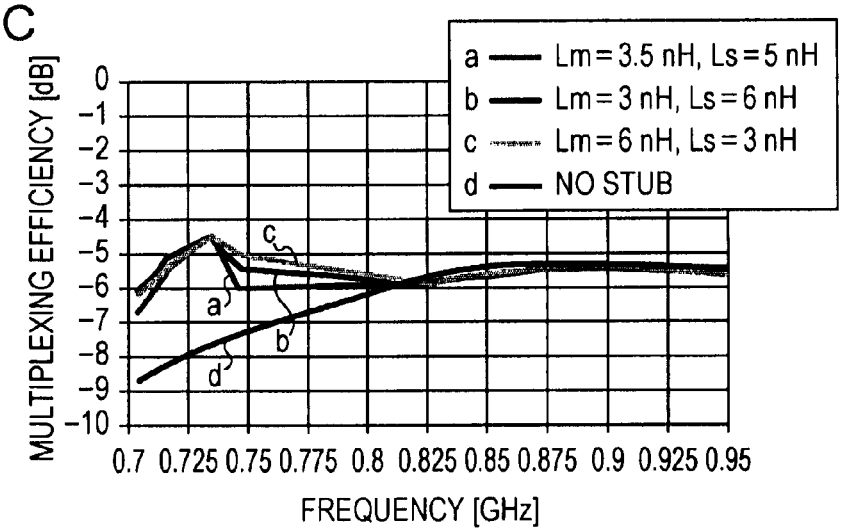

FIGS. 9(*a*), 9(*b*), and 9(*c*) are graphs respectively representing the frequency characteristics of the correlation, antenna efficiency, and multiplexing efficiency of the configuration in FIG. 8.

In FIG. 9(*a*), the waveform a illustrates the case where Lm=3.5 nH and Ls=5 nH, the waveform b the case where Lm=3 nH and Ls=6 nH, and the waveform c the case where Lm=6 nH and Ls=3 nH, respectively. All cases demonstrate that the bandwidth in which the degree of correlation is decreased is widened by making the values of the lumped elements added to the two non-feed elements differ. This is thought to arise from the resonant frequency of both non-feed elements being shifted.

In FIG. 9(*b*), the waveforms a and b respectively represent the antenna efficiency of the main antenna and the sub antenna in the case where Lm=3.5 nH and Ls=5 nH. The waveforms b and c respectively represent the antenna efficiency of the main antenna and the sub antenna in the case where Lm=3 nH and Ls=6 nH. The waveforms e and f respectively represent the antenna efficiency of the main antenna and the sub antenna in the case where Lm=6 nH and Ls=3 nH. This graph demonstrates that the antenna efficiency of the main antenna and the sub antenna in the 700 MHz band fluctuates considerably depending on the combination of Lm and Ls.

In FIG. 9(*c*), the waveform a illustrates the case where Lm=3.5 nH and Ls=5 nH, the waveform b the case where Lm=3 nH and Ls=6 nH, the waveform c the case where Lm=6 nH and Ls=3 nH, and the waveform d the case of no non-feed element. This graph demonstrates that the multiplexing efficiency is improved in the 700 MHz band compared to the case of no non-feed element, regardless of the combination of Lm and Ls.

Figure 10:
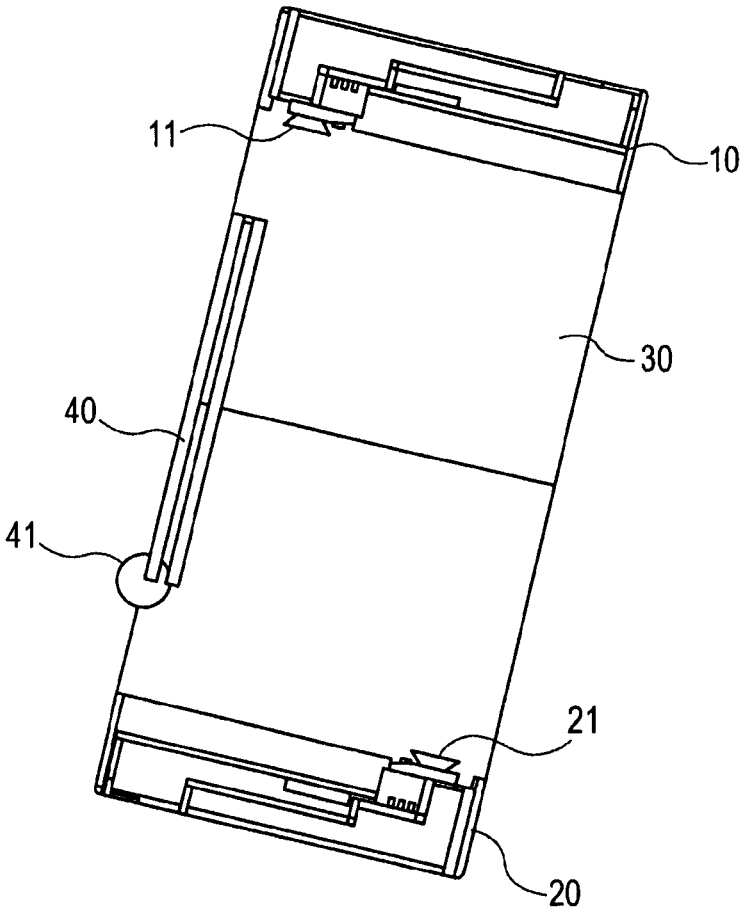
FIG. 10 is a diagram illustrating a modification of the antenna apparatus illustrated in FIG. 3.

FIG. 10 illustrates a modification of the antenna apparatus illustrated in FIG. 3. In the antenna apparatus in FIG. 3, the non-feed element 40 (and its ground point 41) were positioned on the side of the feed point 21 of the antenna unit 20, and the ground point 41 was also positioned comparatively near the feed point 21. In contrast, in the configuration in FIG. 10, the non-feed element 40 is positioned on the side opposite the feed point 21 of the antenna unit 20. The ground point 41 is at a position that is also significantly distant from the feed point 11 of the antenna unit 10.

Figure 11:
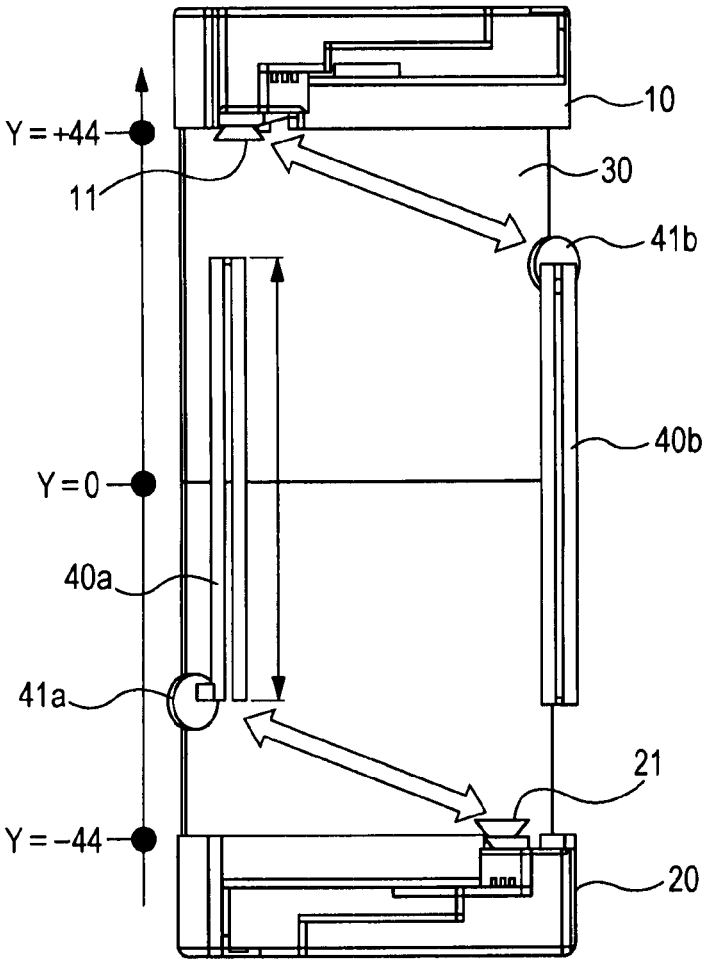
FIG. 11 is a diagram illustrating a modification of the antenna apparatus illustrated in FIG. 6.

FIG. 11 illustrates a modification of the antenna apparatus illustrated in FIG. 6. In the antenna apparatus in FIG. 6, the ground point 41*a* of the non-feed element 40*a* and the ground point 41*b* of the non-feed element 40*b* were positioned near the feed points 11 and 21, respectively. In contrast, in the antenna apparatus in FIG. 11, the positions of the non-feed elements 40*a* and 40*b* have been switched. In so doing, both the ground points 41*a* and 41*b* become distanced far from the feed points 21 and 11.

Figure 12A:
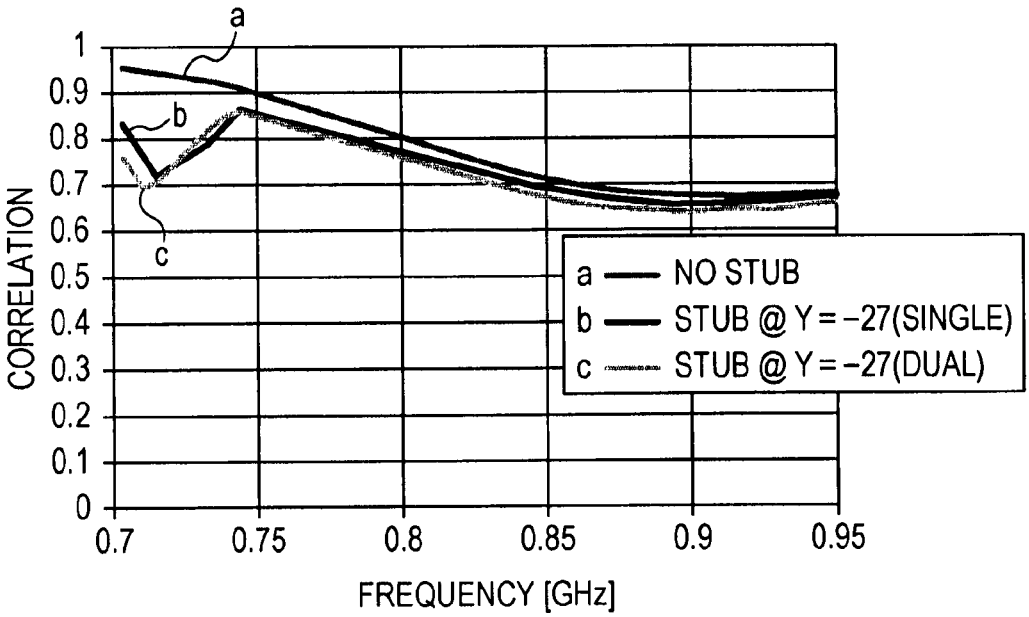
FIGS. 12(*a*) and 12(*b*) are graphs illustrating the frequency characteristics of the correlation and antenna efficiency for the antenna apparatus illustrated in FIGS. 10 and 11.
Figure 12B:
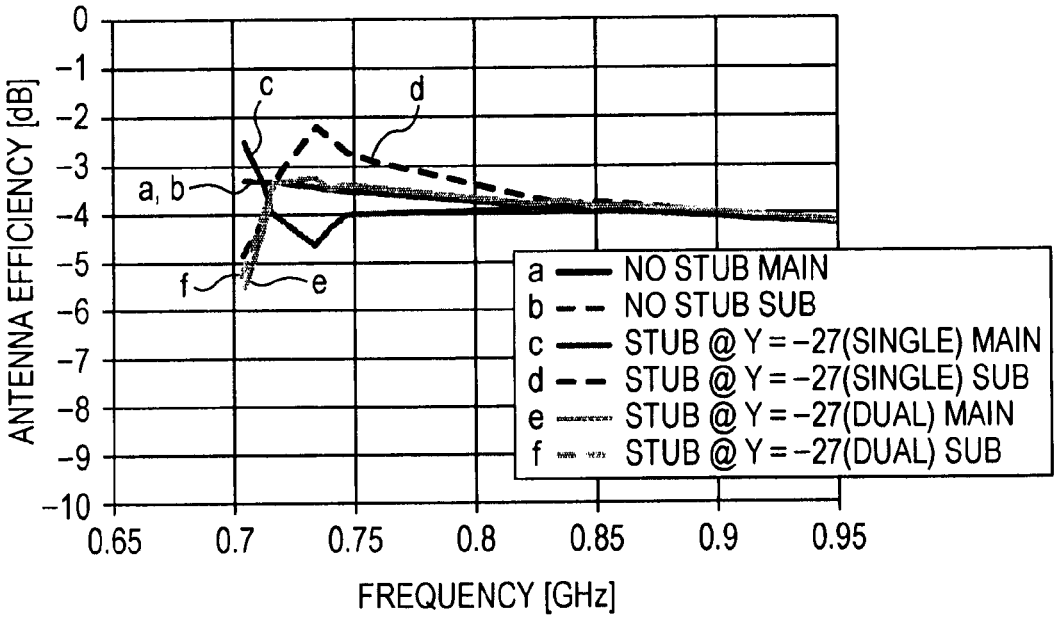

FIGS. 12(*a*) and 12(*b*) are graphs illustrating the frequency characteristics of the correlation and antenna efficiency for the antenna apparatus illustrated in FIGS. 10 and 11.

In FIG. 12(*a*), the waveform a represents the correlation in the case of no non-feed element. The waveform b represents the correlation in the case of using a single non-feed element with a ground point at the −27 mm position (FIG. 10). The waveform c represents the correlation in the case of using two non-feed elements with ground points at the −27 mm position (FIG. 11). The graph demonstrates that for both the waveforms b and c, the correlation coefficient is improved by approximately 0.2 to 0.25 in the 700 MHz band.

In FIG. 12(*b*), the waveform a represents the antenna efficiency of the main antenna in the case of no non-feed element. The waveform b represents the efficiency of the sub antenna in the case of no non-feed element. The waveform c represents the antenna efficiency of the main antenna in the case of using a single non-feed element with a ground point at the −27 mm position. The waveform d represents the antenna efficiency of the sub antenna in the case of using a single non-feed element with a ground point at the −27 mm position. The waveform e represents the antenna efficiency of the main antenna in the case of using two non-feed elements with ground points at the −27 mm position. The waveform f represents the antenna efficiency of the sub antenna in the case of using two non-feed elements with ground points at the −27 mm position. These graphs demonstrate that, even in cases of using a non-feed element with respect to antenna efficiency, cases where the antenna efficiency is good and cases where it is bad are possible depending on whether the antenna is the main or the sub and also on the number of non-feed elements.

Figure 13A:
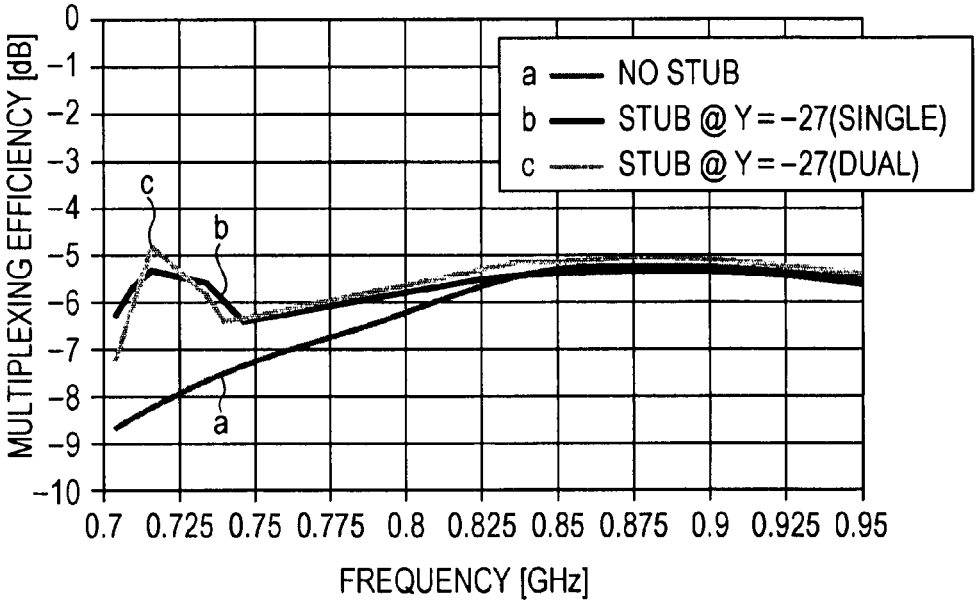
FIGS. 13(*a*) and 13(*b*) are graphs illustrating the frequency characteristics of the multiplexing efficiency and the gain imbalance for the antenna apparatus illustrated in FIGS. 10 and 11.
Figure 13B:
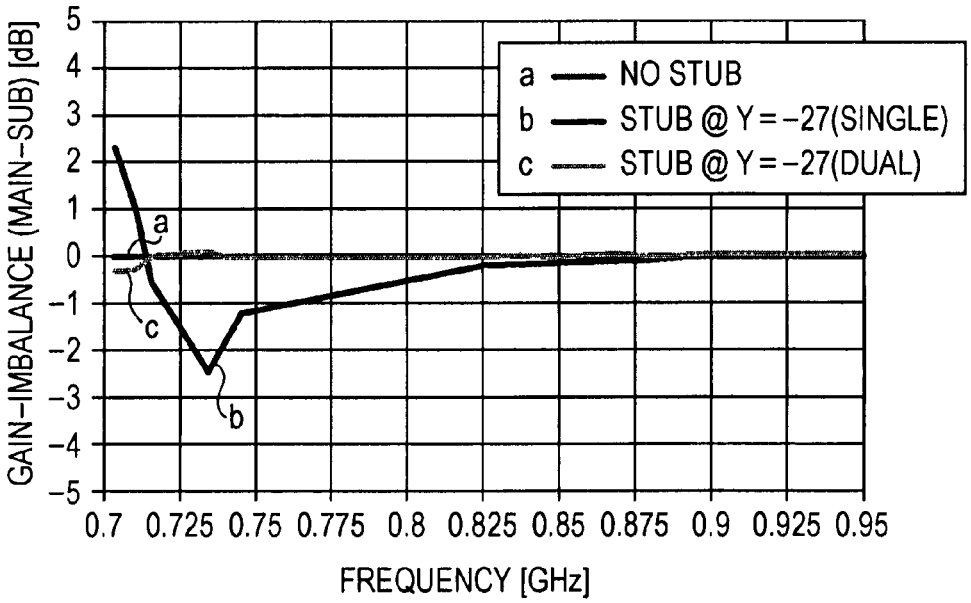

FIGS. 13(*a*) and 13(*b*) are graphs illustrating the frequency characteristics of the multiplexing efficiency and the gain imbalance for the antenna apparatus illustrated in FIGS. 10 and 11.

In FIG. 13(*a*), the waveform a represents the multiplexing efficiency in the case of no non-feed element. The waveform b represents the multiplexing efficiency in the case of using a single non-feed element with a ground point at the −27 mm position. The waveform c represents the multiplexing efficiency in the case of using two non-feed elements with ground points at the −27 mm position. This graph demonstrates that in cases of providing a single or plural non-feed elements, the multiplexing efficiency is improved by approximately 2 to 3 dB compared to the case of no non-feed element.

In FIG. 13(*b*), the waveform a represents the gain imbalance in the case of no non-feed element. The waveform b represents the gain imbalance in the case of using a single non-feed element with a ground point at the −27 mm position. The waveform c represents the gain imbalance in the case of using two non-feed elements with ground points at the −27 mm position. This graph demonstrates that whereas the gain imbalance is large in an antenna apparatus that uses a single non-feed element (FIG. 10), the gain imbalance is favorable in an antenna apparatus that uses two non-feed elements (FIG. 11).

Figure 14:
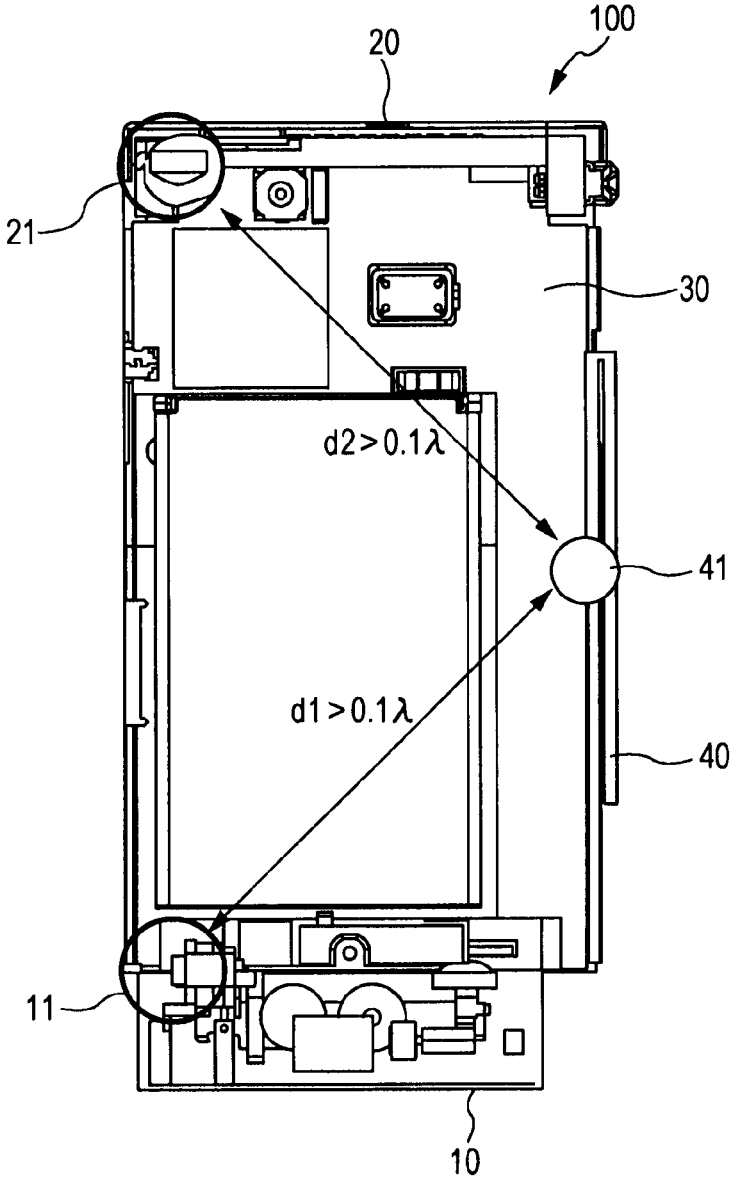
FIG. 14 is a diagram illustrating the principal configuration of an antenna apparatus in accordance with a second embodiment of the present disclosure.

FIG. 14 is a diagram illustrating the principal configuration of an antenna apparatus in accordance with a second embodiment of the present disclosure. This second embodiment is designed to improve the antenna characteristics of the antenna apparatus in the first embodiment. Similarly to the antenna apparatus illustrated in FIG. 3, this antenna apparatus has, as a plurality of antennas for conducting MIMO transmission, a first antenna unit (main antenna) 10 having a first feed point 11 and a second antenna unit 20 (sub antenna) having a second feed point 21. The antenna units 10 and 20 are positioned at one end and the other end in one direction (in this case, the lengthwise direction) of a approximately rectangular board 30. In this drawing, for the sake of convenience, the top/bottom relationship of the first antenna unit 10 and second antenna unit 20 is the reverse of that in FIG. 3, etc. discussed earlier.

The second embodiment differs from the first embodiment in that the respective feed points 11 and 21 of the first antenna unit 10 and the second antenna unit 20 are positioned on the same side of the board 30. Also, the ground point of a non-feed element 40 is positioned in the approximate center of the side of the board 30 opposite to the side where the feed points 11 and 21 exist. The distance d1 from the feed point 11 to the ground point 41 and the distance d2 from the feed point 21 to the ground point 41 are both a given distance or more (herein, 0.1λ). As discussed earlier, the non-feed element 40 may also be grounded at the ground point 41 via a lumped circuit element. The blank part near the center of the board 30 in FIG. 14 represents the battery housing.

Figures 15A, 15B, 15C, 15D:
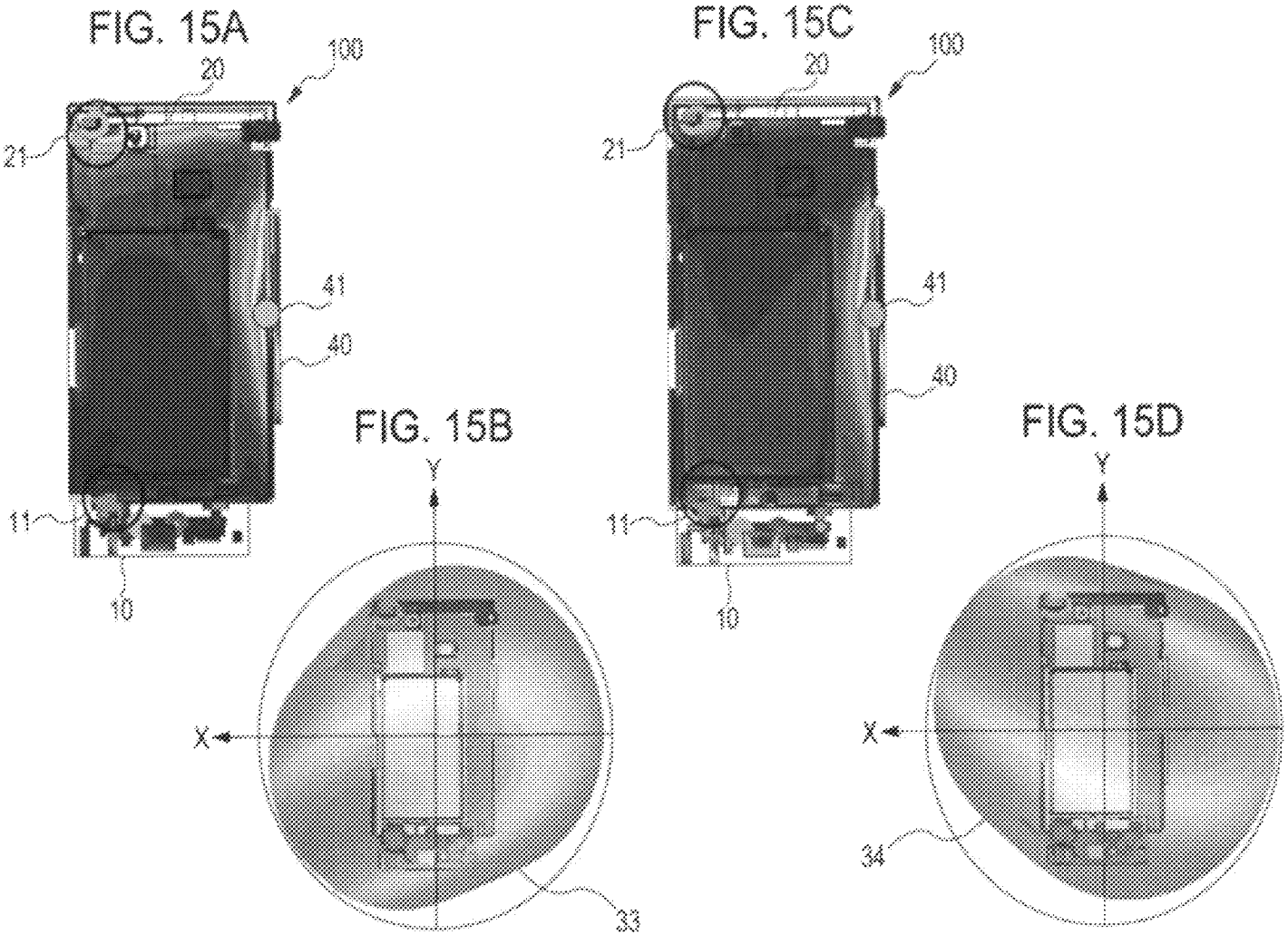
FIGS. 15(*a*) to 15(*d*) are diagrams for explaining operation of the antenna apparatus illustrated in FIG. 14.

FIGS. 15(*a*) to 15(*d*) are diagrams for explaining operation of the antenna apparatus illustrated in FIG. 14. FIGS. 15(*a*) and 15(*b*) represent the current distribution and radiation pattern when the second antenna unit 20 (Port 2) is fed. FIGS. 15(*c*) and 15(*d*) similarly represent the current distribution and radiation pattern when the first antenna unit 10 (Port 1) is fed. The display format of the radiation patterns in FIGS. 15(*b*) and 15(*d*) is as explained in FIGS. 2(*b*) and 2(*c*).

FIG. 15(*a*) demonstrates that current density is high in the vicinity of the fed antenna unit 20 and in the vicinity of the non-feed element. FIG. 15(*c*) demonstrates that current density is high in the vicinity of the fed antenna unit 10 and in the vicinity of the non-feed element. FIGS. 15(*b*) and 15(*d*) both exhibit a doughnut-shaped radiation pattern, and demonstrate that the center axes of the doughnuts are tilted in opposite directions from each other. This point will be explained in further detail with the next drawing.

Figure 16:
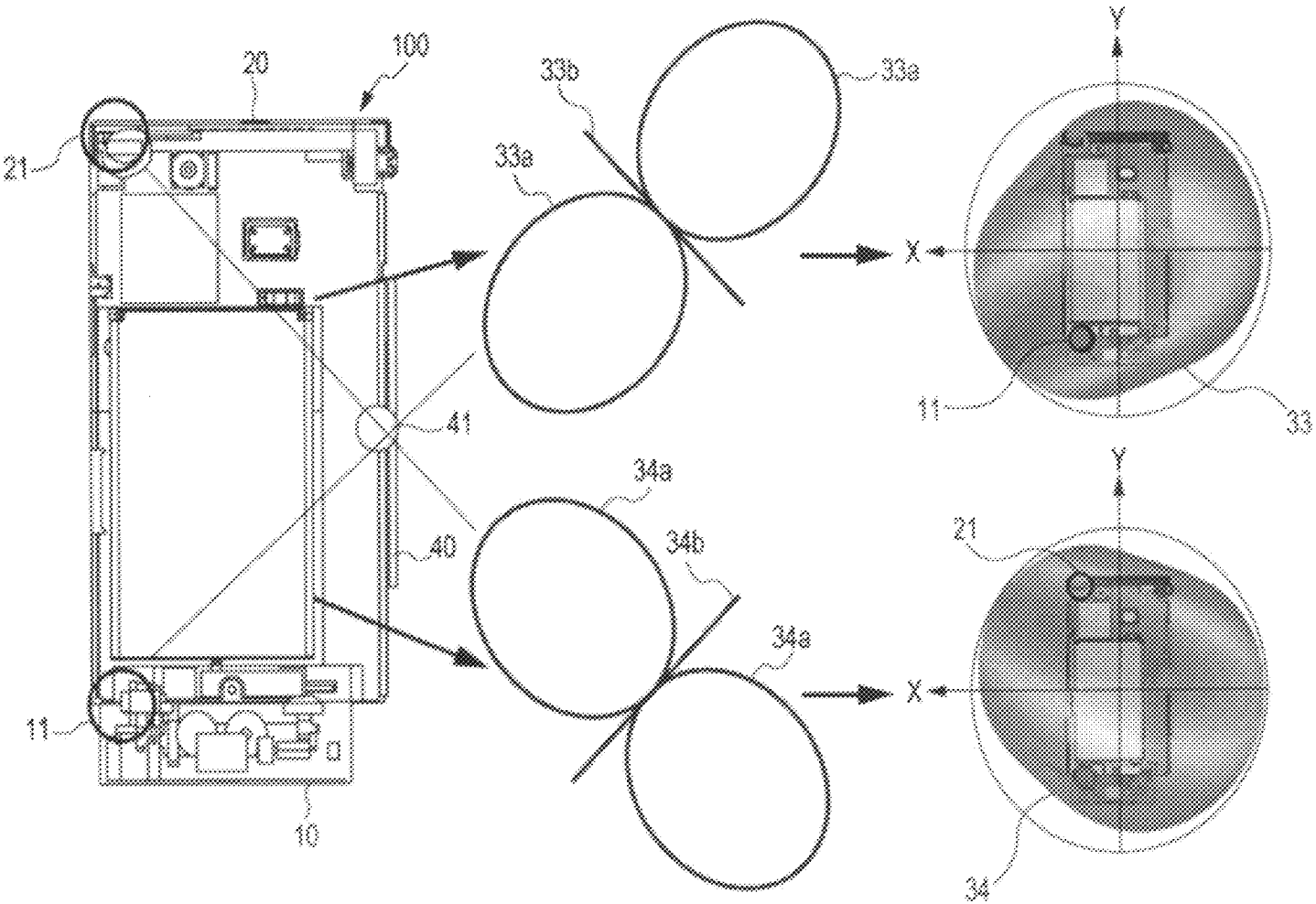
FIG. 16 is a diagram for explaining the relationship between the respective radiation patterns of first and second antenna units.

FIG. 16 is a diagram for explaining the relationship between the respective radiation patterns of the antenna units 10 and 20. The radiation pattern 33*a* obtained by the antenna unit 10 corresponds to a cross-section of the three-dimensional doughnut-shaped radiation pattern 33 taken along its center axis 33*b*. Similarly, the radiation pattern 34*a* obtained by the antenna unit 20 corresponds to a cross-section of the three-dimensional doughnut-shaped radiation pattern 34 taken along its center axis 34*b*. The drawings demonstrate that the center axes 33*b* and 34*b* are tilted in opposite directions with reference to the lengthwise direction of the antenna apparatus. In the example in the drawings, the center axes 33*b* and 34*b* are approximately orthogonal. The center axis 34*b* corresponds to the direction of the straight line linking the feed point 11 and the ground point 41. Similarly, the center axis 33*b* corresponds to the direction of the straight line linking the feed point 21 and ground point 41. Consequently, by setting positional relationships between the feed points 11, 21 and the ground point 41 such that both straight lines are orthogonal, it becomes possible for both radiation patterns (directionality patterns) of the antenna unit 10 and the antenna unit 20 to take an orthogonal relationship. In so doing, the degree of correlation between the two antennas can be maximally decreased.

Figure 17A:
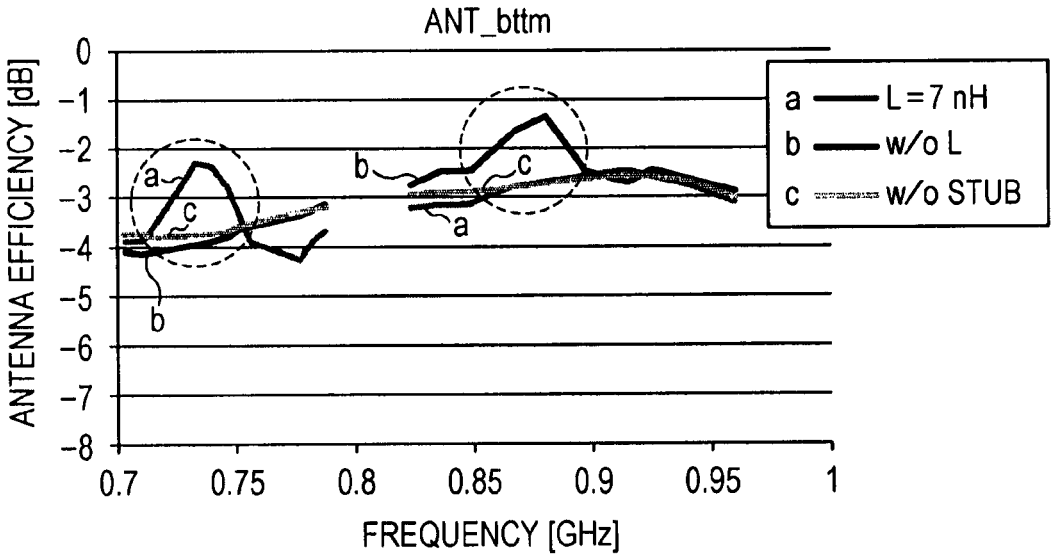
FIGS. 17(*a*) and 17(*b*) are graphs illustrating frequency characteristics in the low band of an antenna apparatus having the configuration illustrated in FIG. 14.
Figure 17B:
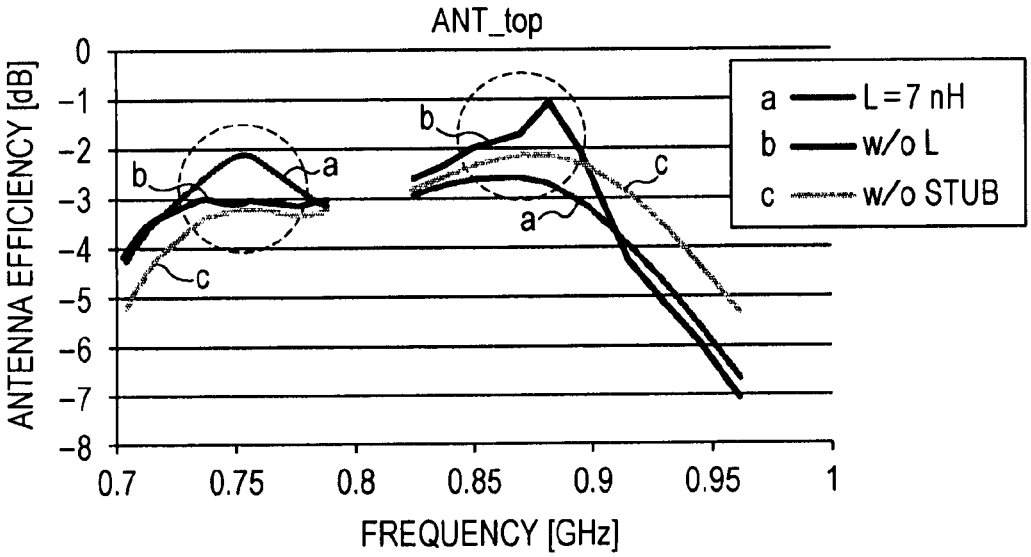

FIG. 17 illustrates the frequency characteristics of the antenna efficiency for a main antenna (ANT_bttm) and a sub antenna (ANT_top) in the low band of an antenna apparatus having the configuration illustrated in FIG. 14. Herein, a frequency range from 700 MHz to 1 GHz is illustrated.

In FIG. 17, the waveform a represents the antenna efficiency in the case where a non-feed element is grounded via a 7 nH inductor. The waveform b represents the antenna efficiency in the case where a non-feed element is grounded without interposing an inductor or other circuit element. The waveform c represents the antenna efficiency in the case of no non-feed element.

The graph in FIG. 17(*a*) demonstrates that antenna efficiency for the main antenna is favorable near 740 MHz in the case of grounding a non-feed element via an inductor as illustrated by the waveform a. This example demonstrates an improvement of approximately 2 dB compared to the case of no non-feed element. Similarly, the graph demonstrates that antenna efficiency is favorable near 880 MHz in the case of grounding a non-feed element without interposing an inductor or other circuit element as illustrated by the waveform b.

The graph in FIG. 17(*b*) demonstrates that antenna efficiency for the sub antenna is favorable near 760 MHz in the case of grounding a non-feed element via an inductor as illustrated by the waveform a. The graph also demonstrates that antenna efficiency is favorable near 880 MHz in the case of grounding a non-feed element without interposing an inductor or other circuit element as illustrated by the waveform b.

Figure 18A:
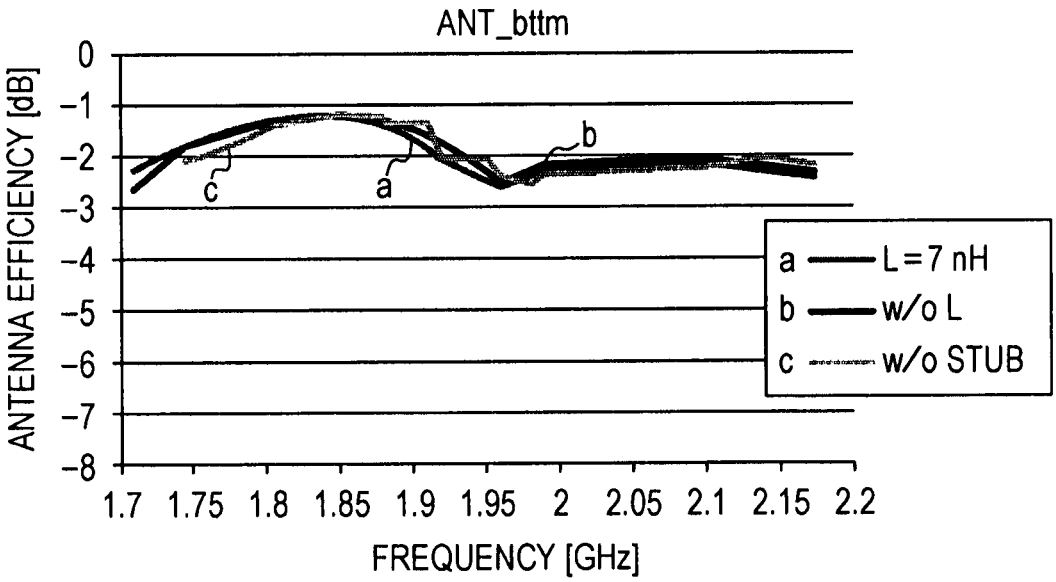
FIGS. 18(*a*) and 18(*b*) are graphs illustrating frequency characteristics in the high band of an antenna apparatus having the configuration illustrated in FIG. 14.
Figure 18B:
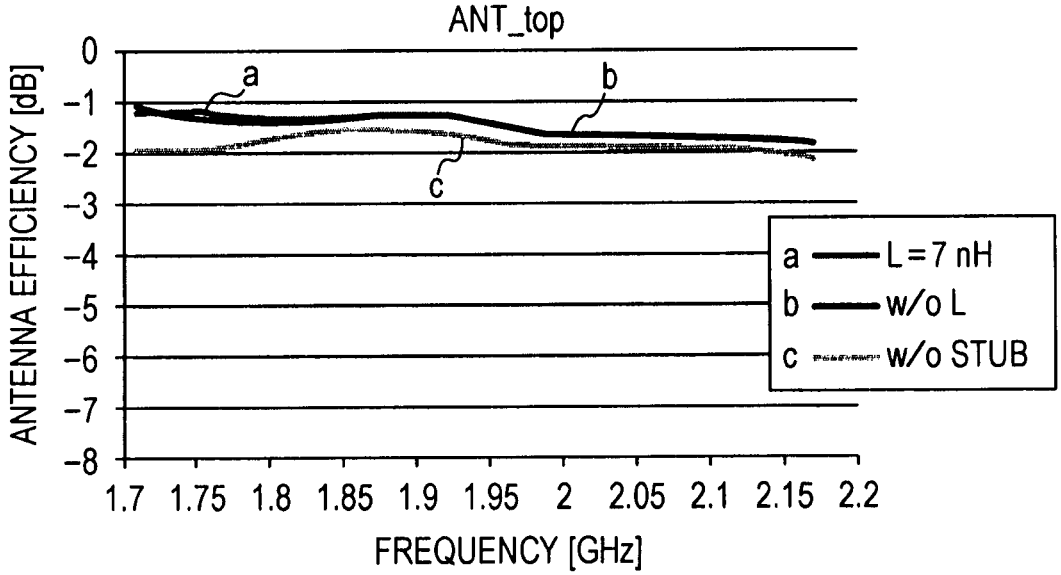

FIG. 18 illustrates the frequency characteristics of the antenna efficiency for a main antenna (ANT_bttm) and a sub antenna (ANT_top) in the high band of an antenna apparatus having the configuration illustrated in FIG. 14. Herein, a frequency range from 1.7 GHz to 2.2 GHz is illustrated.

The graph in FIG. 18(*a*) demonstrates that antenna efficiency for the main antenna is favorable in a range from near 1.8 GHz to near 1.9 GHz in the cases of all waveforms a, b, and c.

The graph in FIG. 18(*b*) demonstrates that antenna efficiency for the sub antenna is favorable compared to the case of not non-feed element in a range from near 1.7 GHz to near 1.9 GHz in the cases of grounding a non-feed element via an inductor as illustrated by waveforms a and b or without an inductor.

The graphs in FIGS. 17 and 18 demonstrate that improvement in antenna efficiency by using a non-feed element exhibits a stronger effect in the low range under certain conditions.

Figure 19A:
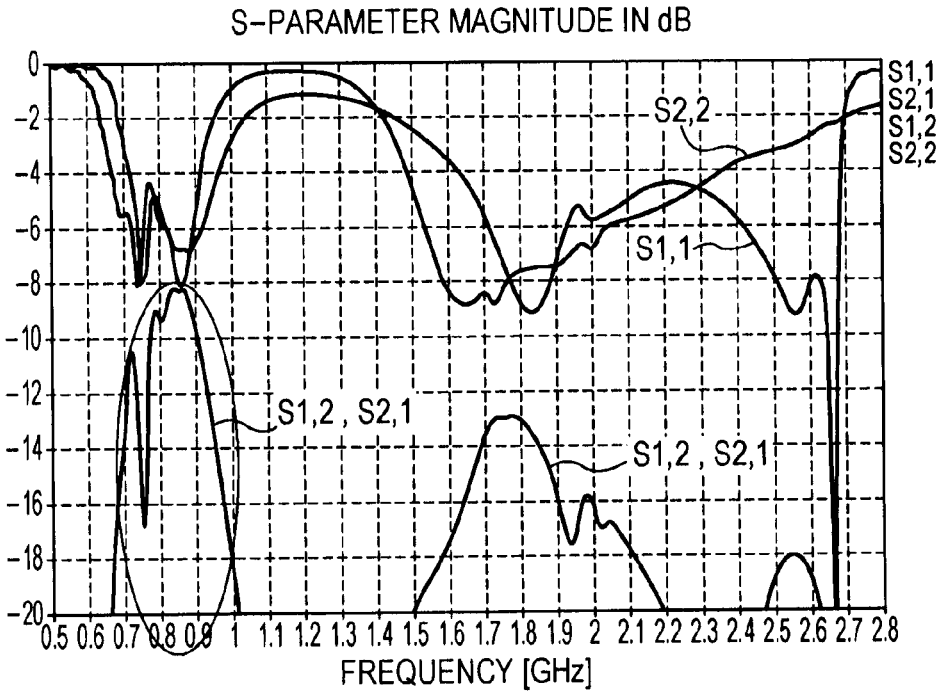
FIGS. 19(*a*) and 19(*b*) are graphs respectively representing the frequency characteristics of the S-parameter in an antenna apparatus having the configuration illustrated in FIG. 14.
Figure 19B:
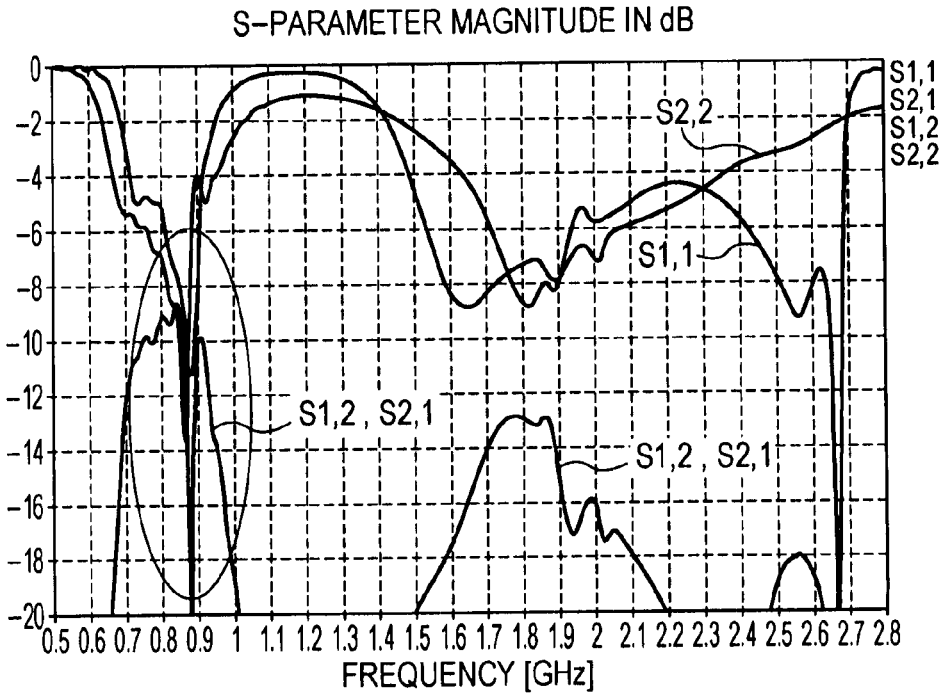

FIGS. 19(*a*) and 19(*b*) respectively represent the frequency characteristics of the S-parameter in an antenna apparatus having the configuration illustrated in FIG. 14 for the case of grounding a non-feed element via a 7 nH inductor and for the case of grounding a non-feed element without an interposing inductor.

S1,1 represents the reflection characteristics of the antenna unit 10 (Port 1), and s2,2 represents the reflection characteristics of the antenna unit 20 (Port 2). The negative peak in the waveform depressions of S1,1 and S2,2 represent the resonant frequency of each antenna unit.

S1,2 and S2,1 represent the mutual transmission characteristics between the antenna unit 10 (Port 1) and the antenna unit 20 (Port 2). S1,2 and S2,1 take the same values relatively, and both waveforms overlap. Small values of S1,2 and S2,1 represent high isolation between the two antennas, which means that the degree of correlation is low. As illustrated in FIG. 19(*b*), it is demonstrated that the isolation becomes a pinpoint near 880 MHz and is greatly improved. Furthermore, interposing an inductor in FIG. 19(*a*) demonstrates that that frequency is moved to near 750 MHz. This suggests that the frequency at which isolation is improved is adjustable according to the value of the interposed inductor.

Figure 20:
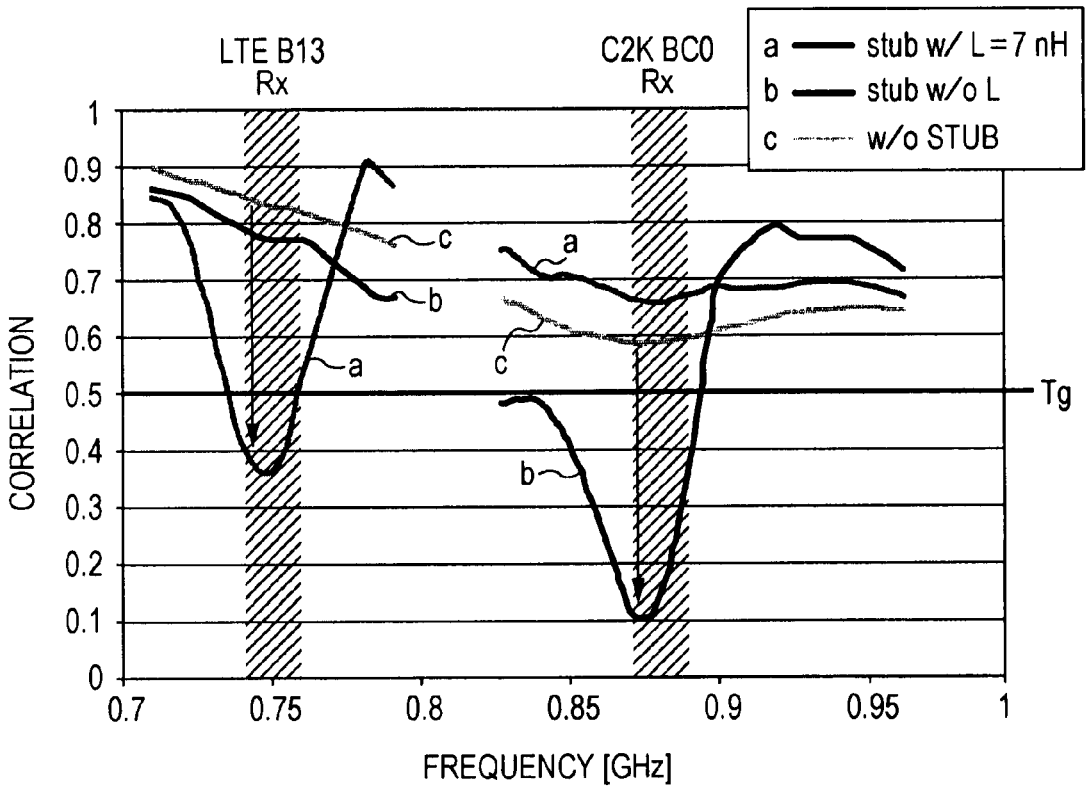
FIG. 20 is a graph representing the frequency characteristics of the correlation of an antenna apparatus having the configuration illustrated in FIG. 14.

FIG. 20 is a graph representing the frequency characteristics of the correlation of an antenna apparatus having the configuration illustrated in FIG. 14. In this example, the reception (Rx) related frequency characteristics are illustrated for a B13 band of LTE and a BC0 band of cdma 2000.

In FIG. 20, the waveform a represents the correlation in the case of grounding a non-feed element via a 7 nH inductor. The waveform b represents the correlation in the case of grounding a non-feed element without interposing an inductor or other circuit element. In the drawing, a target correlation value is illustrated as Tg. The correlation is preferably below this Tg. The waveform c represents the correlation in the case of no non-feed element. As the drawing demonstrates, the correlation for the LTE B13 band is exceptionally favorable in the case of grounding a non-feed element via an inductor as illustrated by the waveform a. The drawing also demonstrates that the correlation for the C2K BC0 band is exceptionally favorable in the case of grounding a non-feed element without interposing an inductor or other circuit element as illustrated by the waveform b.

Figure 21A:
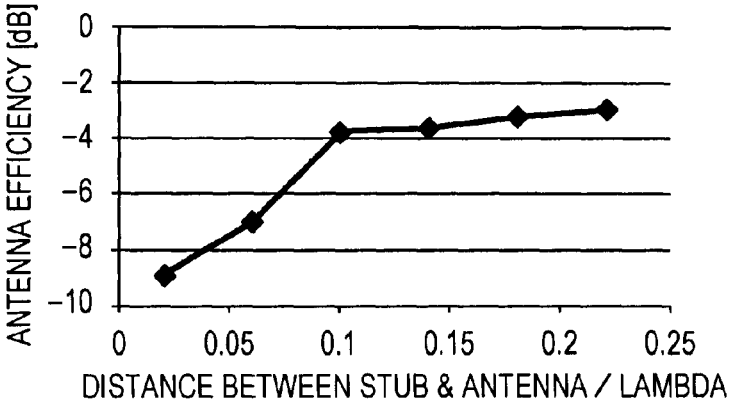
FIGS. 21(*a*), 21(*b*) and 21(*c*) are diagrams for explaining the basis of a preferable given distance.
Figure 21B:
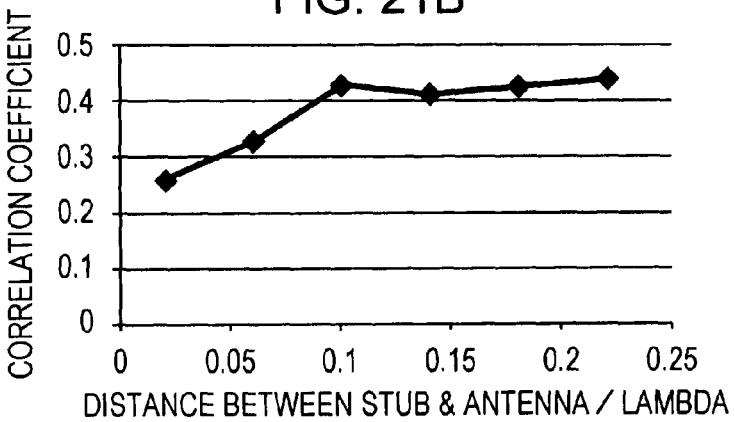
Figure 21C:
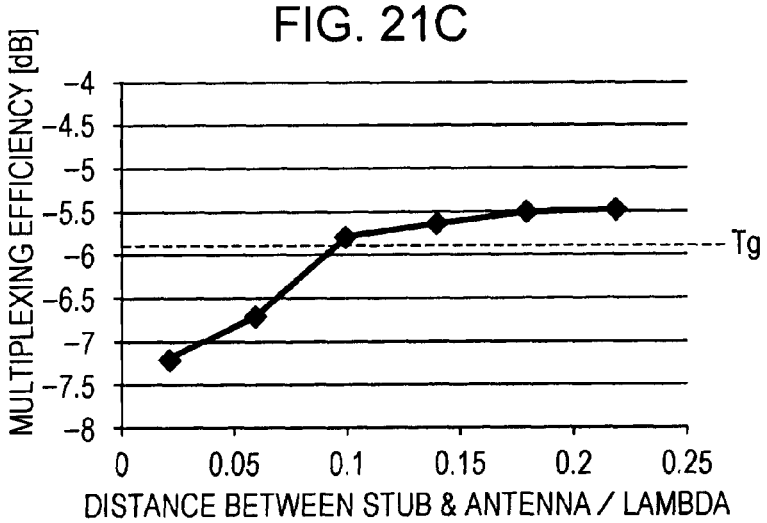

At this point, the basis for taking the above-discussed given distance to be 0.1λ or more will be explained by FIG. 21. FIGS. 21(*a*), 21(*b*), and 21(*c*) respectively illustrate the relationship between the antenna efficiency, correlation coefficient, and multiplexing efficiency versus the distance from a non-feed element to an antenna feed point in the antenna apparatus illustrated in FIG. 14. This distance is the distance when the non-feed element is distanced from the vicinity of the sub antenna, and its units are the wavelength λ. These graphs illustrate that the antenna efficiency, the correlation coefficient, and the multiplexing efficiency are all favorable in the case where the wavelength is 0.1λ or more. Particularly, if evaluated with the multiplexing efficiency by which the effects of antenna efficiency and correlation can be summarily checked, the graph demonstrates that the multiplexing efficiency value becomes equal to or greater than the target (Tg) of −6 dB in cases where the distance is 0.1λ, or more.

Figure 22:
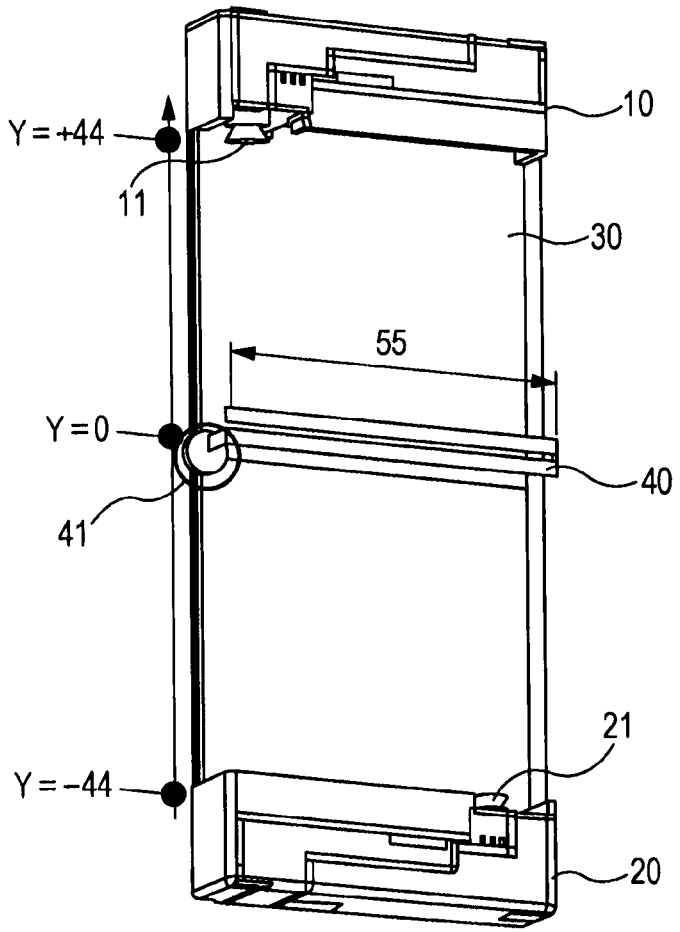
FIG. 22 is a diagram illustrating a modification of the antenna apparatus illustrated in FIG. 10 (and other drawings).

Next, FIG. 22 illustrates a modification of the antenna apparatus illustrated in FIG. 10 (and other drawings). In FIG. 10, a non-feed element 40 was configured to extend in a direction along an edge (the long edge) of the board 30. In contrast, in the configuration in FIG. 22, a ground point 41 is positioned at the midpoint along an edge of the board 30, and the non-feed element 40 is made to extend and fold back parallel to the short edges of the board 30. For the coordinates (Y) of the "midpoint", the center point along the axis is set to 0, with the antenna unit 10 side set as positive and the antenna unit 20 side set as negative.

Figure 23A:
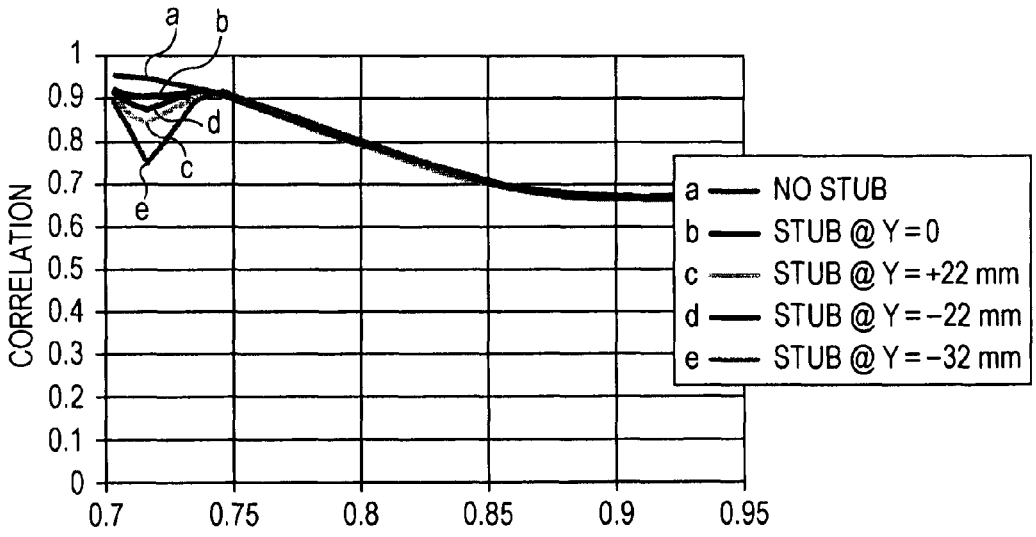
FIGS. 23(*a*) and 23(*b*) are graphs illustrating the frequency characteristics of the correlation and antenna efficiency for the antenna apparatus illustrated in FIG. 22.
Figure 23B:
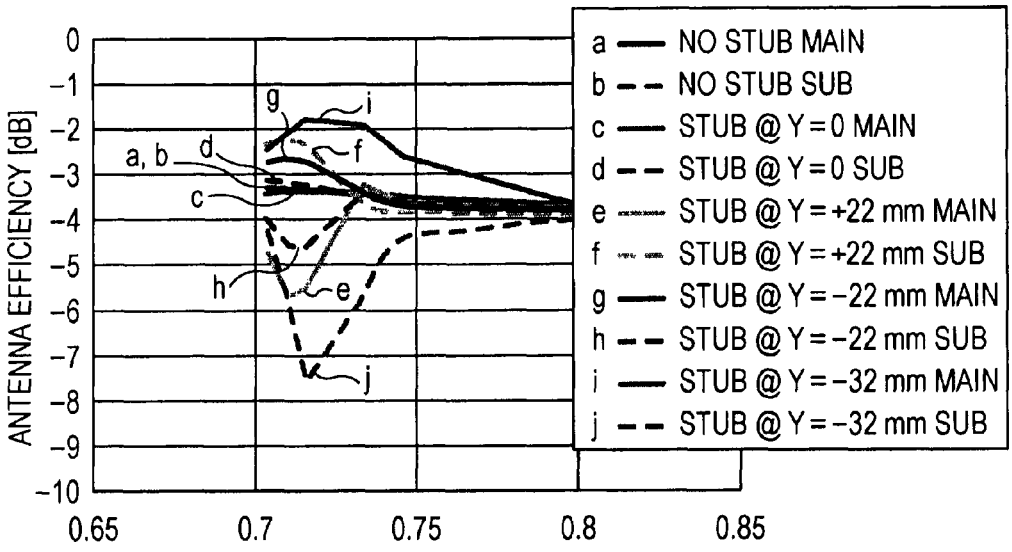

FIGS. 23(*a*) and 23(*b*) are graphs illustrating the frequency characteristics of the correlation and antenna efficiency for the antenna apparatus illustrated in FIG. 22.

In FIG. 23(*a*), the waveform a represents the correlation in the case of no non-feed element. The waveform b represents the correlation in the case of using a non-feed element with a ground point at the Y=0 mm position. The waveform c represents the correlation in the case of using a non-feed element with a ground point at the Y=+22 mm position. The waveform d represents the correlation in the case of using a non-feed element with a ground point at the Y=−22 mm position. The waveform e represents the correlation in the case of using a non-feed element with a ground point at the Y=−32 mm position. The graph demonstrates that although the degree of improvement in the correlation in the 700 MHz band differs according to the position of the ground point, the correlation is improved in the case of a non-feed element compared to the case of no non-feed element.

In FIG. 23(*b*), the waveform a represents the antenna efficiency of the main antenna (the antenna unit 10) in the case of no non-feed element. The waveform b represents the antenna efficiency of the sub antenna (the antenna unit 20) in the case of no non-feed element. The waveform c represents the antenna efficiency of the main antenna in the case of using a non-feed element with a ground point at the Y=0 mm position. The waveform d represents the antenna efficiency of the sub antenna in the case of using a non-feed element with a ground point at the Y=0 mm position. The waveform e represents the antenna efficiency of the main antenna in the case of using a non-feed element with a ground point at the Y=+22 mm position. The waveform f represents the antenna efficiency of the sub antenna in the case of using a non-feed element with a ground point at the Y=+22 mm position. The waveform g represents the antenna efficiency of the main antenna in the case of using a non-feed element with a ground point at the Y=−22 mm position. The waveform h represents the antenna efficiency of the sub antenna in the case of using a non-feed element with a ground point at the Y=−22 mm position. The waveform i represents the antenna efficiency of the main antenna in the case of using a non-feed element with a ground point at the Y=−32 mm position. The waveform j represents the antenna efficiency of the sub antenna in the case of using a non-feed element 40 with a ground point at the Y=−32 mm position.

The graph in FIG. 23(*b*) demonstrates that for each antenna unit, the antenna efficiency degrades as its feed point nears the ground point 41 of the non-feed element 40.

Figure 24:
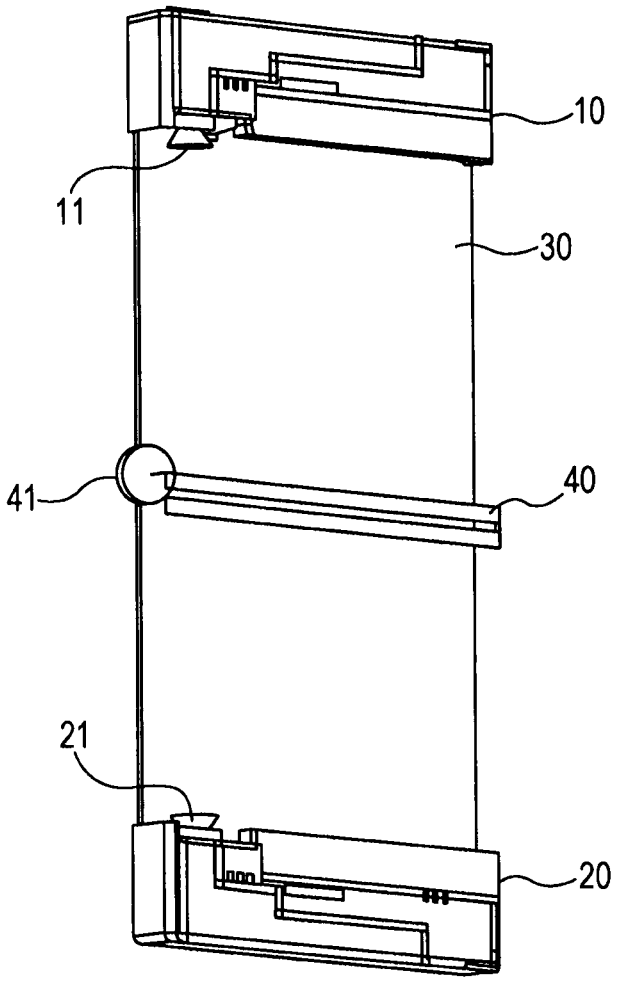
FIG. 24 is a diagram illustrating a modification of the antenna apparatus illustrated in FIG. 22.

FIG. 24 is a diagram illustrating a modification of the antenna apparatus illustrated in FIG. 22. In FIG. 22, the feed points 11 and 21 of the antenna unit 10 and the antenna unit 20 were respectively positioned on opposite sides of the board 30. In contrast, in the configuration illustrated in FIG. 24, the feed points 11 and 21 are positioned on the same side of the board 30. The ground point 41 of the non-feed element 40 is also positioned on the same side of the board 30. Although graphs representing the characteristics of an antenna apparatus with the configuration in FIG. 24 are not particularly illustrated, if judged from the above findings, it is inferred that characteristics will be favorable when the ground point 41 is at the Y=0 mm position equally distanced from the two feed points 11 and 21.

Figure 25:
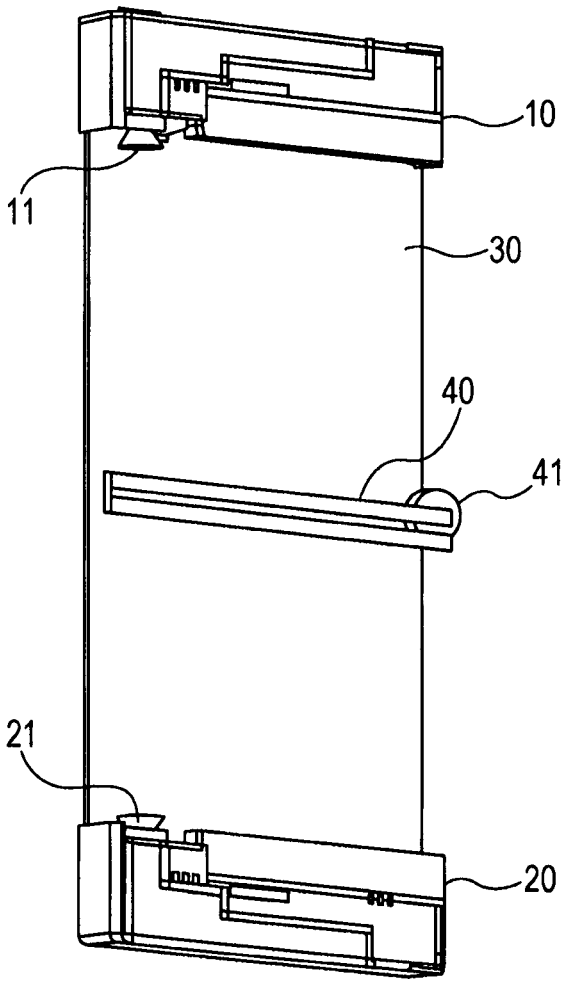
FIG. 25 is a diagram illustrating a modification of the antenna apparatus illustrated in FIG. 24.

FIG. 25 is a diagram illustrating a modification of the antenna apparatus illustrated in FIG. 24. In the configuration in FIG. 25, the ground point 41 of the non-feed element 40 is positioned on the opposite side of the board 30 with respect to the feed points 11 and 21. This configuration can also be seen as a modification of the antenna apparatus illustrated in FIG. 14. In other words, the ground point 41 of the non-feed element 40 in the antenna apparatus in FIG. 14 has been positioned on the side opposite to the feed points 11 and 21. In this configuration, the positional relationship between the feed points 11, 21 and the ground point 41 is the same as the case in FIG. 14, and antenna characteristics similar to the antenna apparatus in FIG. 14 are expected. However, the configuration in FIG. 14, wherein the non-feed element 40 is maximally offset outwards away from the ground plane of the board 30, is more favorable from a correlation perspective.

Figure 26:
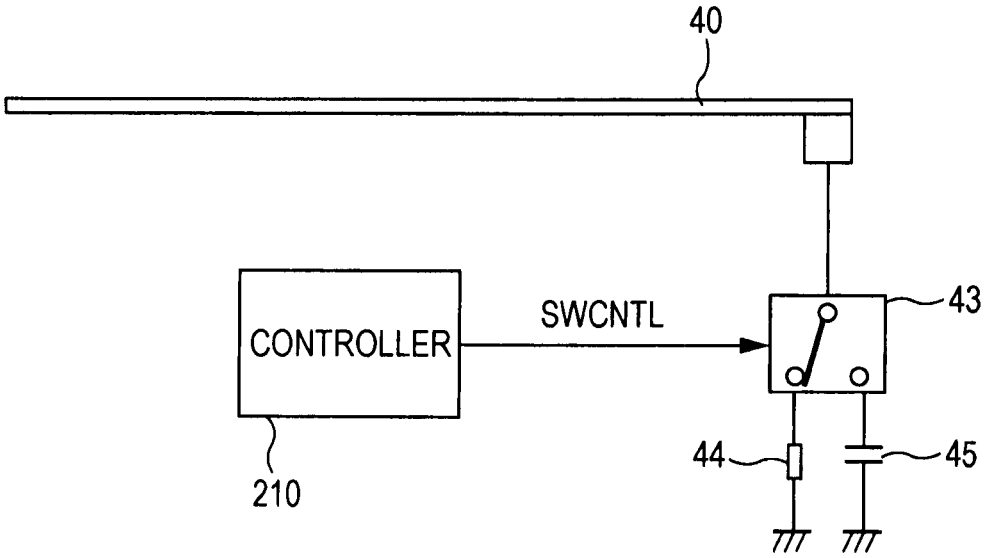
FIG. 26 is a diagram illustrating a configuration in which the grounding conditions of a non-feed element can be switched.
Figure 27A:
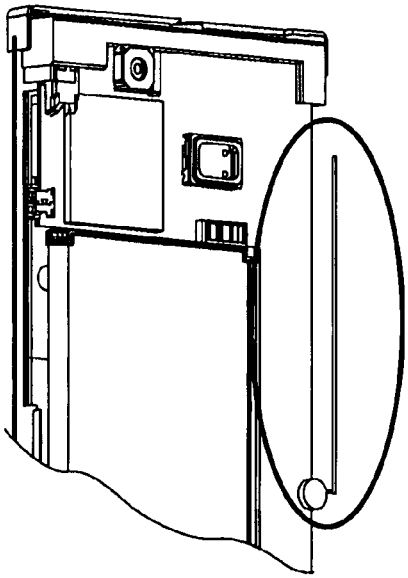
FIG. 27(*a*), 27(*b*), 27(*c*) and 27 (*d*) are diagrams illustrating exemplary configurations of a non-feed element.
Figure 27B:
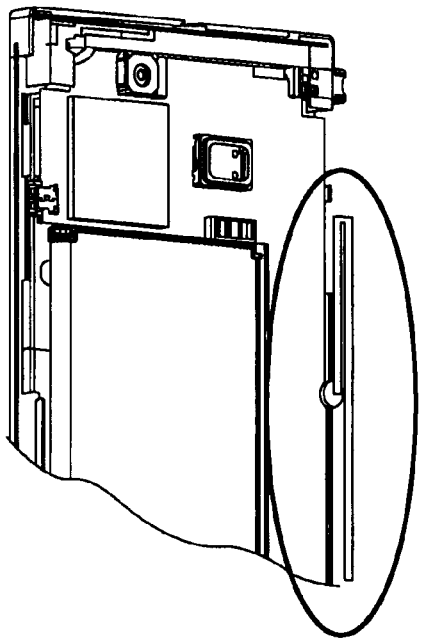
Figure 27C:
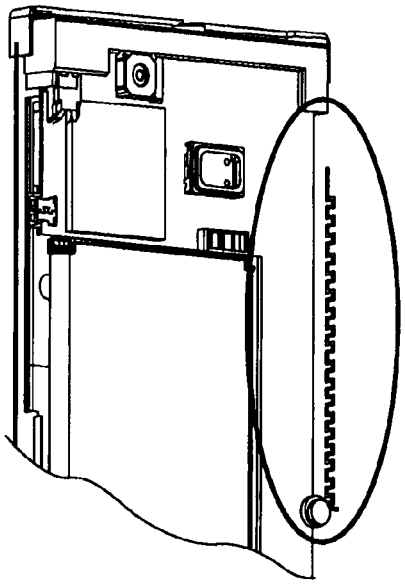
Figure 27D:
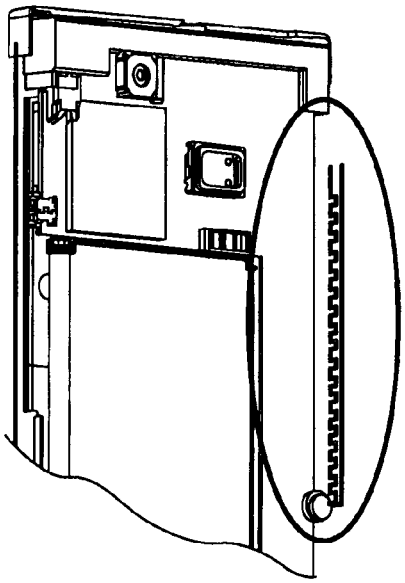

As discussed above, when grounding a non-feed element, favorable characteristics for each in-use band are obtained by modifying the presence or absence of an interposing circuit element and the value of an interposing circuit element depending on the in-use band. Accordingly, a configuration in which the grounding conditions of the non-feed element 40 can be switched is provided, as illustrated in FIG. 26. One end of the non-feed element 40 is coupled to the single pole side of a single pole double throw (SPDT) antenna switch 43. Inductors, capacitors, resistors, or other lumped circuit elements 44 and 45 are coupled to the double throw sides of the antenna switch 43 between the terminals and ground. One of the circuit elements 44 and 45 may also include a lead with a resistance value of 0. Switching control of the antenna switch 43 is conducted in accordance with a control signal SWCNTL from the controller 210 of a wireless communication apparatus equipped with the antenna apparatus. For example, the controller 210 may output a control signal SWCNTL ON/OFF signal depending on whether an LTE or a 3G (Third Generation) communication system is to be used.

Next, exemplary configurations of the non-feed element discussed above will be explained by FIG. 27. Besides the monopole type illustrated in FIG. 27(*a*) and the folded monopole type illustrated in FIG. 27(*b*), the non-feed element may also be the meander type illustrated in FIG. 27(*c*). It is also conceivable to join two of these for a dual resonance configuration. For example, the non-feed element may also be a compound type using meander and monopole as illustrated in FIG. 27(*d*). In the case of a compound type, elements with different electrical lengths can be jointly used for a single non-feed element.

Figure 28:
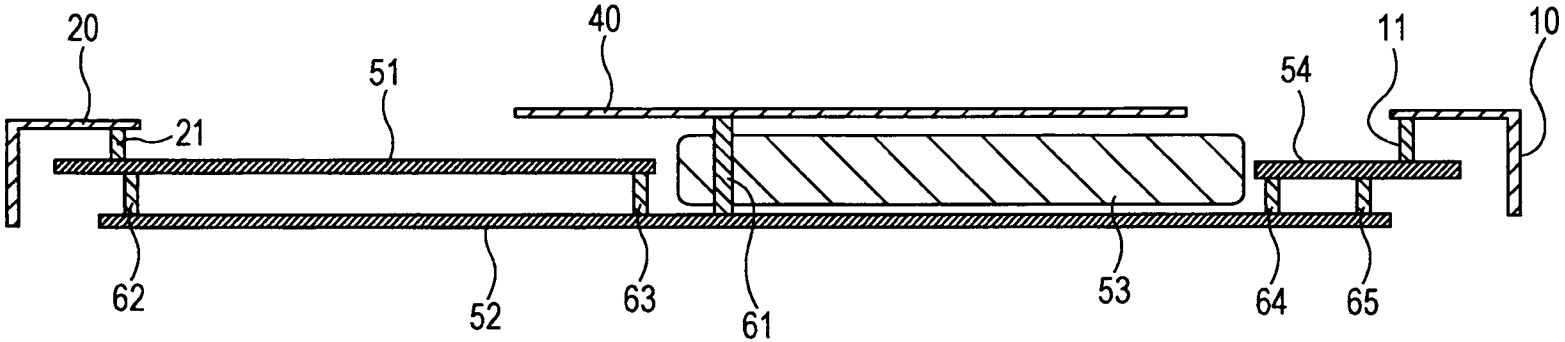
FIG. 28 is a cross-sectional diagram representing a schematic configuration of an embodiment of a wireless communication apparatus implementing an antenna apparatus.

FIG. 28 is a cross-sectional diagram representing a schematic configuration of an embodiment of a wireless communication apparatus implementing one of the antenna apparatus discussed earlier.

The board 30 discussed earlier may be split into multiple parts in some cases. In the example in FIG. 28, a board is divided into a main printed circuit board 51 and a sub printed circuit board 54. The antenna unit 20 (sub antenna) is mounted onto the main printed circuit board 51, while the antenna unit 10 (main antenna) is mounted onto the sub printed circuit board 54. The main printed circuit board 51 and the sub printed circuit board 54 are supported on a conducting plate such as a stainless steel plate (SUS) 52 via contact leaves 62 to 65. In order to provide mechanical reinforcement and a ground plane, such a conducting plate is ordinarily embedded inside a plastic part constituting the chassis for nearly the entire length of the wireless communication apparatus, for example, or provided in a secured manner. In this example, a space housing a battery 53 is provided on the stainless steel plate 52 between the main printed circuit board 51 and the sub printed circuit board 54. The grounding of the non-feed element 40 can typically be conducted via the board 30, but with such a configuration, the non-feed element 40 provided in the vicinity of the battery 53 is grounded to the stainless steel plate 52 via the contact leaf 61. Obviously, this grounding may also be conducted via the above-discussed circuit element (and switch). Herein, the main printed circuit board 51 and the sub printed circuit board 54 are coupled to each other by a lead such as a coaxial cable (not illustrated).

Figure 29:
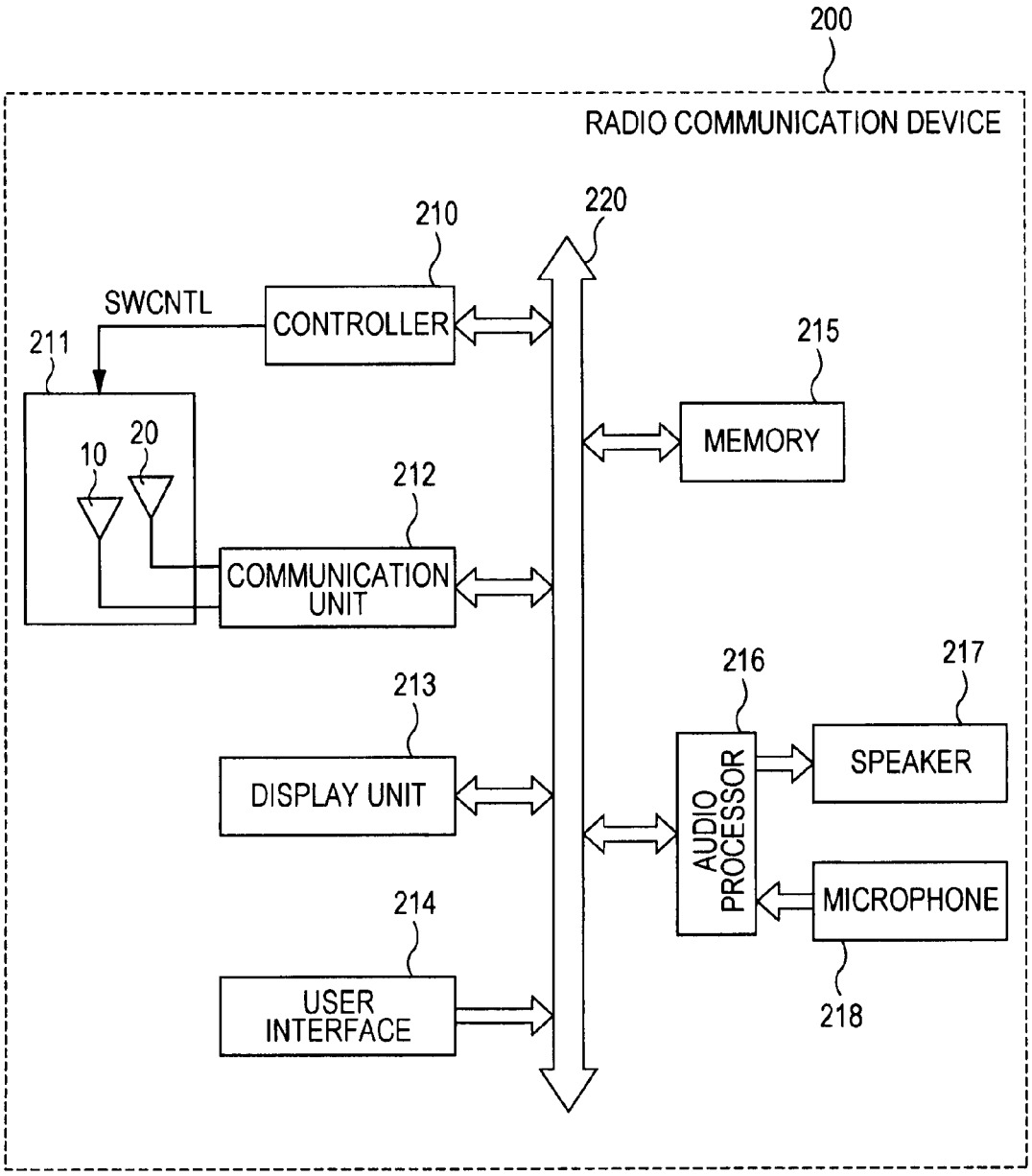
FIG. 29 is a block diagram illustrating an exemplary configuration of a wireless communication apparatus housing an antenna apparatus in accordance with one of the embodiments.

FIG. 29 illustrates an exemplary configuration of a wireless communication apparatus housing an antenna apparatus in accordance with one of the above embodiments.

A wireless communication apparatus 200 is provided with a controller 210, an antenna apparatus 211, a communication unit 212, a display unit 213, an operation unit 214, a memory unit 215, an audio processor 216, a speaker 217, and a microphone 218. The controller 210 is coupled to each unit via a bus 220. The controller 210 is a member that conducts control of respective units and required data processing, and includes an MPU or other processor. The communication unit 212 is a member that conducts wireless communication by radio waves with a base station, etc. via the antenna apparatus 211. The antenna apparatus 211 includes a plurality of antenna units 10, 20 for conducting MIMO transmission as discussed earlier. In the case where the antenna apparatus 211 includes the antenna switch 43 and the circuit element 44 discussed earlier in FIG. 26, a control signal SWCNTL is supplied from the controller 210 to the antenna apparatus 211.

The display unit 213 is a member that provides a display interface to the user, and includes a display device such as an LCD or organic EL device that displays information on a display screen. The operation unit 214 is a member that provides an input interface to the user, and includes an input apparatus such as a keypad and various control keys. The memory unit 215 is a member that stores various application programs such as an OS and communication application programs as programs to be executed by the controller 210, as well as required data, and includes memory such as ROM and RAM. The audio processor 216 is a member that processes incoming telephony audio, video file audio, and music data, and includes codecs, etc. The audio processor 216 is coupled to the speaker 217, which outputs audio, and to the microphone 218, which picks up outgoing telephony audio, etc.

The foregoing thus explains preferred embodiments of the present disclosure, but it is possible to conduct various modifications and alterations other than those discussed above. In other words, it should be understood by those skilled in the art that various modifications, combinations, and other embodiments may occur depending on design requirements or other factors insofar as they are within the scope of the claims or the equivalents thereof. For example, the specific numerical values such as the numbers of components, distances, frequencies, dimensions, etc. given in the specification and drawings are merely examples for the sake of explanation, and the present disclosure is not to be limited thereto.

The invention claimed is:

1. An antenna apparatus comprising:

an approximately rectangular board;

a first antenna disposed in proximity a first edge of the board and having a first feed point;

a second antenna disposed in proximity to a second edge of the board, which is opposite to the first edge of the board and having a second feed point; and a non-feed element grounded at a ground point disposed in proximity to the second feed point, the non-feed element including a first portion including a first end connected to the ground point and extending in parallel along a third edge of the board; and a second portion having a length substantially similar to the first portion and extending in parallel with the first portion, the second portion including a first end connected to a second end of the first portion and a second end located closer to the second feed point than the first feed point.

2. The antenna apparatus of claim 1, wherein the first feed point is located in proximity to a fourth edge of the board and the second feed point is located in proximity to the third edge of the board.

3. The antenna apparatus of claim 2, wherein the third edge of the board opposes the fourth edge of the board.

4. The antenna apparatus of claim 1, wherein the length of the first and second portions of the non-feed element is approximately 55 mm.

5. The antenna apparatus of claim 1, wherein the ground point is located approximately 27 mm from a center of the non-feed element.

6. The antenna apparatus of claim 1, wherein the ground point is located approximately 37 mm from a center of the non-feed element.

7. The antenna apparatus of claim 1, further comprising:

a second non-feed element grounded at a second ground point disposed in proximity to the first second feed point.

8. The antenna apparatus of claim 7, wherein the second non-feed element comprises:

a first portion including a first end connected to the second ground point and extending in parallel along a fourth edge of the board; and a second portion having a length substantially similar to the first portion and extending in parallel with the first portion, the second portion including a first end connected to a second end of the first portion and a second end located closer to the first feed point than the second feed point.

9. An antenna apparatus comprising:

an approximately rectangular board;

a first antenna disposed in proximity a first edge of the board and having a first feed point;

a second antenna disposed in proximity to a second edge of the board, which is opposite to the first edge of the board and having a second feed point; and a non-feed element grounded at a ground point disposed in proximity to the first feed point, the non-feed element including a first portion including a first end connected to the ground point and extending in parallel along a third edge of the board; and a second portion having a length substantially similar to the first portion and extending in parallel with the first portion, the second portion including a first end connected to a second end of the first portion and a second end located closer to the first feed point than the second feed point.

10. The antenna apparatus of claim 9, wherein the first feed point is located in proximity to the third edge of the board and the second feed point is located in proximity to a fourth edge of the board.

11. The antenna apparatus of claim 10, wherein the third edge of the board opposes the fourth edge of the board.

12. The antenna apparatus of claim 9, wherein the length of the first and second portions of the non-feed element is approximately 55 mm.

13. The antenna apparatus of claim 9, wherein the ground point is located approximately 27 mm from a center of the non-feed element.

14. The antenna apparatus of claim 9, wherein the ground point is located approximately 37 mm from a center of the non-feed element.

15. The antenna apparatus of claim 9, further comprising:

a second non-feed element grounded at a second ground point disposed in proximity to the second feed point.

16. The antenna apparatus of claim 15, wherein the second non-feed element comprises:

a first portion including a first end connected to the second ground point and extending in parallel along a fourth edge of the board; and a second portion having a length substantially similar to the first portion and extending in parallel with the first portion, the second portion including a first end connected to a second end of the first portion and a second end located closer to the second feed point than the first feed point.

* * * * *

UNITED STATES PATENT AND TRADEMARK OFFICE

CERTIFICATE OF CORRECTION

PATENT NO. : 8,947,318 B2
APPLICATION NO. : 13/358059
DATED : February 3, 2015
INVENTOR(S) : Akihiro Bungo It is certified that error appears in the above-identified patent and that said Letters Patent is hereby corrected as shown below:

On the title page, Item (73), the Assignees' information is incorrect. Item (73) should read:

-- (73) Assignees: Sony Corporation, Tokyo (JP);
Sony Mobile Communications Inc., Tokyo (JP) --

Signed and Sealed this
Twentieth Day of October, 2015

Michelle K. Lee

Michelle K. Lee
*Director of the United States Patent and Trademark Office*